US010925135B2

(12) United States Patent
Slivka et al.

(10) Patent No.: US 10,925,135 B2
(45) Date of Patent: Feb. 16, 2021

(54) LED BUTTON CALIBRATION FOR A WALL MOUNTED CONTROL DEVICE

(71) Applicant: Crestron Electronics, Inc., Rockleigh, NJ (US)

(72) Inventors: Benjamin M. Slivka, Hillsalde, NJ (US); Dennis J. Hromin, Park Ridge, NJ (US)

(73) Assignee: Crestron Electronics, Inc., Rockleigh, NJ (US)

( * ) Notice: Subject to any disclaimer, the term of this patent is extended or adjusted under 35 U.S.C. 154(b) by 0 days.

(21) Appl. No.: 16/787,935

(22) Filed: Feb. 11, 2020

(65) Prior Publication Data

US 2020/0260548 A1 Aug. 13, 2020

Related U.S. Application Data

(60) Provisional application No. 62/803,642, filed on Feb. 11, 2019.

(51) Int. Cl.

| | |
|---|---|
| ***H05B 45/22*** | (2020.01) |
| ***H05B 45/325*** | (2020.01) |
| ***H05B 45/37*** | (2020.01) |
| ***H05B 45/10*** | (2020.01) |
| ***H05B 47/19*** | (2020.01) |

(52) U.S. Cl.

CPC ..... *H05B 45/22* (2020.01); *H05B 45/325* (2020.01)

(58) Field of Classification Search

CPC ..... H05B 45/37; H05B 45/14; H05B 39/047; H05B 45/10; H05B 47/10; H05B 45/20; H05B 47/11

USPC ..... 315/294, 152, 210, 287, 297

See application file for complete search history.

(56) References Cited

U.S. PATENT DOCUMENTS

| | | | | |
|---|---|---|---|---|
| 2003/0000817 | A1* | 1/2003 | Farage | G06F 3/0202 200/314 |
| 2010/0302169 | A1* | 12/2010 | Pance | G06F 3/0237 345/170 |
| 2011/0026256 | A1* | 2/2011 | Szolyga | G06F 1/1684 362/253 |
| 2012/0019164 | A1* | 1/2012 | Gambeski | B64D 47/02 315/294 |
| 2012/0176063 | A1* | 7/2012 | Hatley | H05B 45/20 315/297 |
| 2012/0206369 | A1* | 8/2012 | Chou | G06F 3/0202 345/170 |
| 2014/0106735 | A1* | 4/2014 | Jackson | H05B 47/19 455/419 |
| 2015/0022110 | A1* | 1/2015 | Sisto | H05B 45/24 315/210 |
| 2015/0334799 | A1* | 11/2015 | Ascorra | G06F 1/16 315/76 |

(Continued)

OTHER PUBLICATIONS sRGB, Wikipedia, printed last edited on Feb. 8, 2020, available at en.wikipedia.org/wiki/SRGB.

(Continued)

*Primary Examiner* — Wei (Victor) Y Chan

(74) *Attorney, Agent, or Firm* — Crestron Electronics, Inc.

(57) ABSTRACT

An apparatus, system, and method for the calibration of backlight LEDs of control device buttons to achieve color uniformity and to accurately create colors that are consistent from button to button and device to device.

25 Claims, 14 Drawing Sheets

(56) References Cited

U.S. PATENT DOCUMENTS

2017/0024020 A1* 1/2017 Kirkpatrick ..... H05B 45/20

OTHER PUBLICATIONS

Ryan Juckett, RGB Color Space Conversion, May 16, 2010, available at www.ryanjuckett.com/programming/rgb-color-space-conversion/.
Wyman, et al., Simple Analytic Approximations to the CIE XYZ Color Matching Functions, Journal of Computer Graphics Techniques, vol. 2, Nov. 2, 2013, available at jcgt.org/published/0002/02/01/paper.pdf.
John Walker, Colour Rendering of Spectra, Apr. 25, 1996, available at www.fourmilab.ch/documents/specrend/.
Douglas A. Kerr , The CIE XYZ and xyY Color Spaces, Mar. 21, 2010, available at dougkerr.net/Pumpkin/articles/CIE_XYZ.pdf.
Elle Stone, Completely Painless Programmer's Guide to XYZ, RGB, ICC, xyY, and TRCs, Feb. 2015, available at ninedegreesbelow.com/photography/xyz-rgb.html.
Lecture 3, Color Representation, available at cs.haifa.ac.il/hagit/courses/ist/Lectures/IST03_ColorXYZ.pdf.
Lee Boon Hooi, Understand RGB LED mixing ratios to realize optimal color in signs and displays, LEDs Magazine, May 14, 2013, available at www.ledsmagazine.com/smart-lighting-iot/color-tuning/article/16695054/understand-rgb-led-mixing-ratios-to-realize-optimal-color-in-signs-and-displays-magazine.
Don Klipstein, How Many Red, Green, and Blue LEDs to make White, Jan. 2, 2008, available at donklipstein.com/ledrgb2w.html.
C. A. Bouman, Chromaticity Coordinates, Digital Image Processing, Jan. 9, 2017, available at engineering.purdue.edu/~bouman/ece637/previous/ece637S2017/notes/pdf/ColorSpaces.pdf.
Darel Rex Finley, HSP Color Model—Alternative to HSV (HSB) and HSL, 2006, Darel Rex Finley, available at alienryderflex.com/hsp.html.
Formulae, Canvas, Nov. 11, 1972, available at canvas.instructure.com/courses/742361/files/19721111/download?verifier=jlkFacgbgFjLGwgZ17sNKk41RvcXQLBc0clu77rN&wrap=1.
Color Conversion Algorithms, printed on Jul. 20, 2015, available at www.cs.rit.edu/~ncs/color/t_convert.html.
Brian Neltner, Implementing arbitrary color correction with the mykil, Neltner Labs, Mar. 17, 2013, available at www.neltnerlabs.com/saikoled/implementing-arbitrary-color-correction-with-the.
Formula to determine brightness of RGB color, StackOverflow, last dated Jun. 22, 2016, available at stackoverflow.com/questions/596216/formula-to-determine-brightness-of-rgb-color.
Calculating the Perceived Brightness of a Color, Nbd-Tech, Apr. 27, 2008, available at www.nbdtech.com/Blog/archive/2008/04/27/Calculating-the-Perceived-Brightness-of-a-Color.aspx.
Solid-State Lighting Technology Fact Sheet, LED Color Characteristics, U.S. Department of Energy, PNNL-SA-117512, Apr. 2016, available at www.energy.gov/sites/prod/files/2016/08/f33/led-color-characteristics-factsheet.pdf.
FastLED HSV Colors, GitHub, Jan. 30, 2014, available at github.com/FastLED/FastLED/wiki/FastLED-HSV-Colors.
Lee, et al., Power-Constrained RGB-to-RGBW Conversion for Emissive Displays, Pennsylvania State University, 2014, available at 150.162.46.34:8080/icassp2014/papers/p1214-lee.pdf.
Can, et al., A Compact and Efficient Method of RGB to RGBW Data Conversion for OLED Microdisplays, EURODISPLAY, 2011, available at pdfs.semanticscholar.org/d58e/17e4bdcc79cf845-a53b185df6733f9da7fe2.pdf?_ga=2.173508965.734875384.1582216212-2136025314.1582216212.
RGB Colour WheelInterface Object for CrestronSmart Graphics, Ultamation, Feb. 20, 2015, available at docplayer.net/129067268-Rgb-colour-wheel-interface-object-for-crestron-smart-graphics.html.
Bishop, et al., The Sciene of Color, TAOS Colorimetry Tutorial, Feb. 28, 2006.
CIE 1931 color space, Wikipedia, printed on Aug. 26, 2017, available at en.wikipedia.org/wiki/CIE_1931_color_space.
White Point, Wikipedia, last edited on Nov. 28, 2016, available at en.wikipedia.org/wiki/White_point.
CIELUV, Wikipedia, last edited Mar. 30, 2017, available at en.wikipedia.org/wiki/CIELUV.
HSL and HSV, Wikipedia, last edited Feb. 18, 2020, available at en.wikipedia.org/wiki/HSL_and_HSV.
Relative Luminance, Wikipedia, last edited on Dec. 26, 2017, available at en.wikipedia.org/wiki/Relative_luminance.
Neltner, Why Every LED Light Should be Using HIS Colorspace, SaikoLED, Feb. 21, 2013, available at blog.saikoled.com/post/43693602826/why-every-led-light-should-be-using-hsi.
How to convert from HSI to RGB+white, SaikoLED, Mar. 5, 2013, available at blog.saikoled.com/post/44677718712/how-to-convert-from-hsi-to-rgb-white.
Lee, et al., Precise Dimming and Color Control of LED Systems Based on Color Mixing, IEEE Transactions on Power Electronics, vol. 31, No. 1, Jan. 2016.

* cited by examiner

LED BUTTON CALIBRATION FOR A WALL MOUNTED CONTROL DEVICE

BACKGROUND OF THE INVENTION

Technical Field

Aspects of the embodiments relate to wall mounted control devices, and more specifically to an apparatus, system and method for the calibration of backlight LEDs of wall mounted control device buttons.

Background Art

The popularity of home and building automation has increased in recent years partially due to increases in affordability, improvements, simplicity, and a higher level of technical sophistication of the average end-user. Generally, automation systems integrate various electrical and mechanical system elements within a building or a space, such as a residential home, commercial building, or individual rooms, such as meeting rooms, lecture halls, or the like. Examples of such system elements include heating, ventilation and air conditioning (HVAC), lighting control systems, audio and video (AV) switching and distribution, motorized window treatments (including blinds, shades, drapes, curtains, etc.), occupancy and/or lighting sensors, and/or motorized or hydraulic actuators, and security systems, to name a few.

One way a user can be given control of an automation system, is through the use of one or more control devices, such as keypads. A keypad is typically mounted in a recessed receptacle in a building wall, commonly known as a wall or a gang box, and comprises one or more buttons or keys each assigned to perform a predetermined or assigned function. Assigned functions may include, for example, turning various types of loads on or off, or sending other types of commands to the loads, for example, orchestrating various lighting presets or scenes of a lighting load.

Typically, the various buttons are printed with indicia to either identify their respective functions or the controlled loads. These buttons may include backlighting via light emitting diodes (LEDs). Giving the customer the ability to change backlight color of these buttons to any desired color or the color temperature of white is an added feature. For example, different button backlight colors may be used to distinguish between buttons, load types (e.g., emergency load), or the load state (e.g., on or off), or button backlight colors may be chosen to complement the surroundings or to give a pleasing visual effect.

Multicolor LEDs, such as Red-Green-Blue (RGB) LEDs, may be used to produce different colored backlighting. Each RGB LED comprises red, green, and blue LED emitters in a single package. Almost any color can be produced by independently adjusting the intensities of each of the three RGB LED emitters. In order to do this effectively and visually appealing, backlighting needs to be consistent from button to button in both color and brightness. In addition, because keypads are generally placed in proximity to each other, for example when they are ganged in a single electrical box, backlight color and brightness also needs to appear consistent from unit to unit. For example, if a user selects the buttons to light up in red, the buttons should consistently show the same red color at the same brightness level. However, colors and intensities of RGB LEDs vary from slight to significant variations even when choosing RGB LEDs from the same manufactured batch. For example, if pure 100% red is selected, simply blasting the red LED emitter full power is insufficient, because if white is selected for an adjacent button the white backlit button will appear dimmed due to color mixing of the RGB LED emitters. As such, it is desired for the colors to appear as having the same brightness to the user—consistent from button to button and unit to unit.

Normally, consistency is accomplished by purchasing binned LEDs—i.e., sorted LEDs in a bin that have similar light output. Unfortunately, LED manufacturers do not provide reliable and consistent binned RGB LEDs because the combination of multiple LED color emitters in one package results in far too many bins for the manufacturer to maintain. This is mainly an issue when trying to create white with an RGB LED without using additional warm-white and cool-white LEDs in the unit. While the eye is not as sensitive to differences in color of colored LEDs, it is very sensitive to differences in the color temperature of white—where a 50K difference can be perceived.

Accordingly, a need has arisen for an apparatus, system, and method for the calibration of backlight LEDs of wall mounted control device buttons to achieve color uniformity and to accurately create colors that are consistent from button to button and device to device.

SUMMARY OF THE INVENTION

It is an object of the embodiments to substantially solve at least the problems and/or disadvantages discussed above, and to provide at least one or more of the advantages described below.

It is therefore a general aspect of the embodiments to provide an apparatus, system, and method for the calibration of backlight LEDs of wall mounted control device buttons to achieve color uniformity and to accurately create colors that are consistent from button to button and device to device.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered to be illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

BRIEF DESCRIPTION OF THE SEVERAL VIEWS OF THE DRAWINGS

Figure 1:
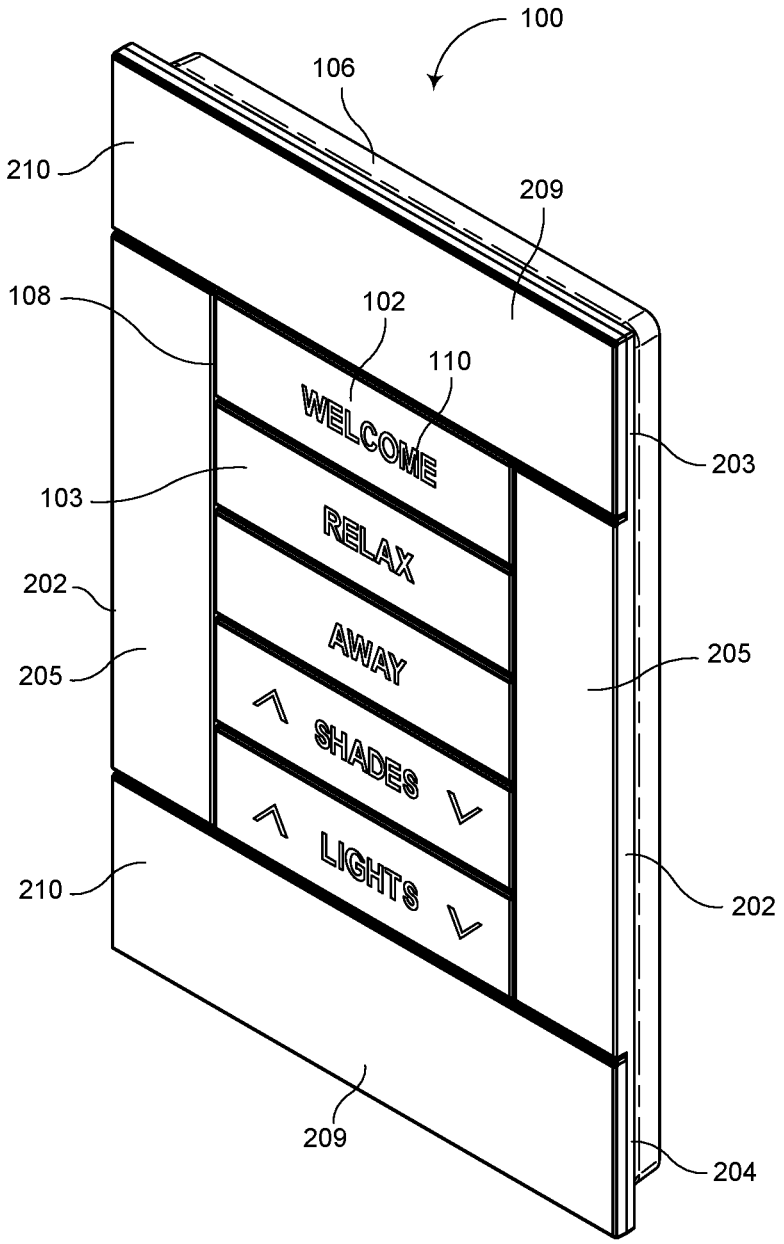

FIG. 1 illustrates a perspective front view of an illustrative wall mounted control device according to an illustrative embodiment.

Figure 2:
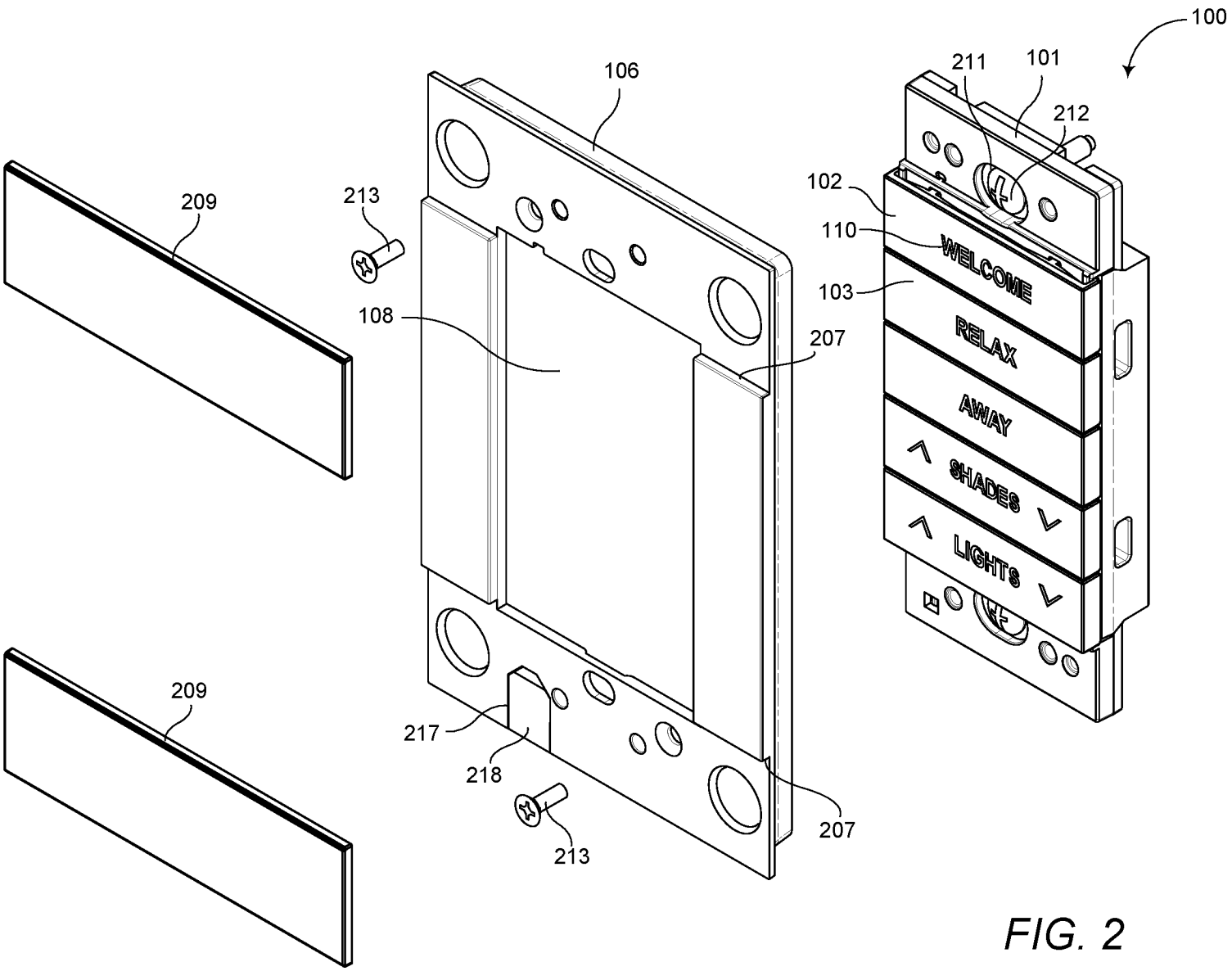

FIG. 2 illustrates a perspective front view of the control device with the faceplate removed according to an illustrative embodiment.

Figure 3:
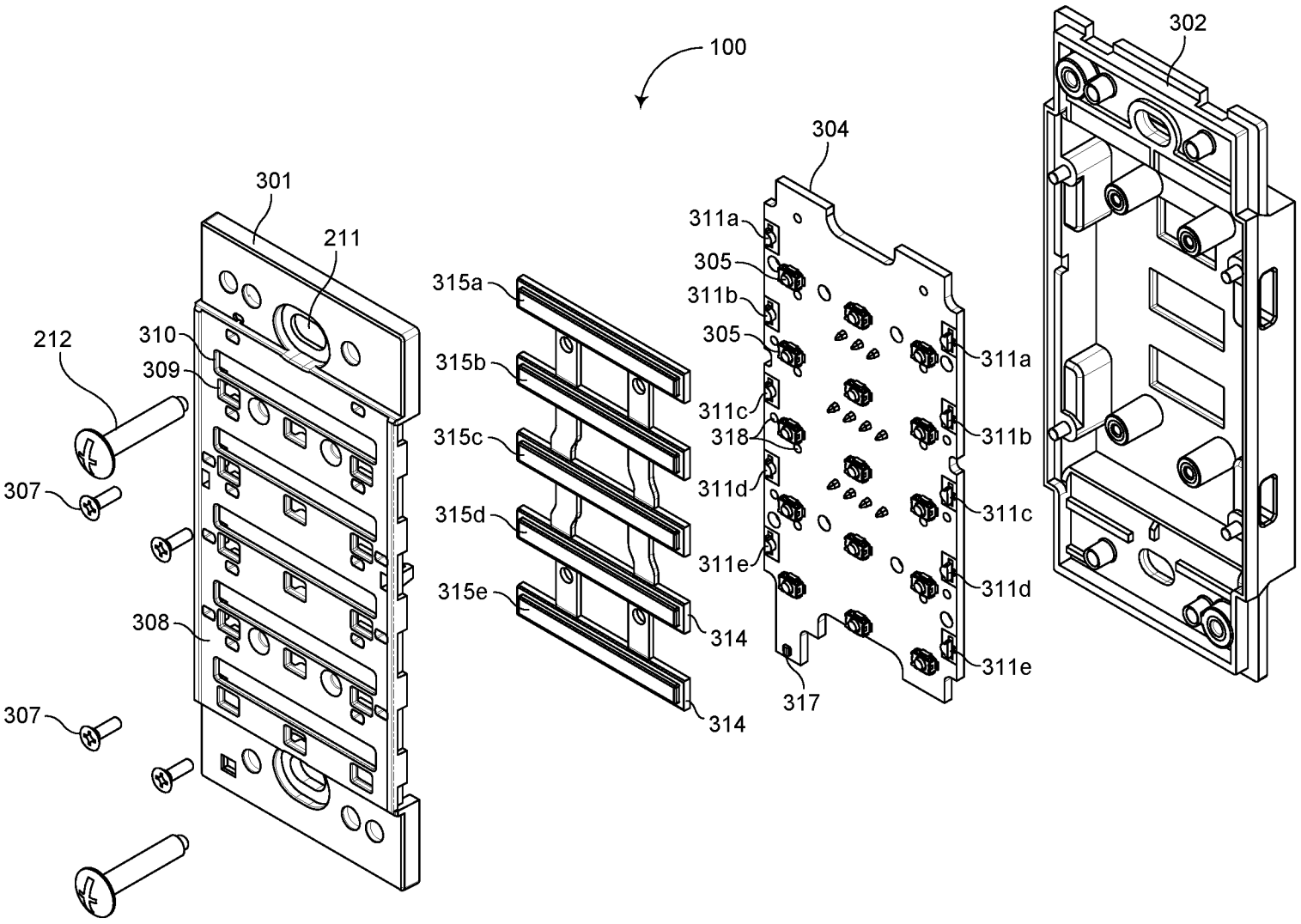

FIG. 3 illustrates an exploded perspective front view of the control device according to an illustrative embodiment.

Figure 4:
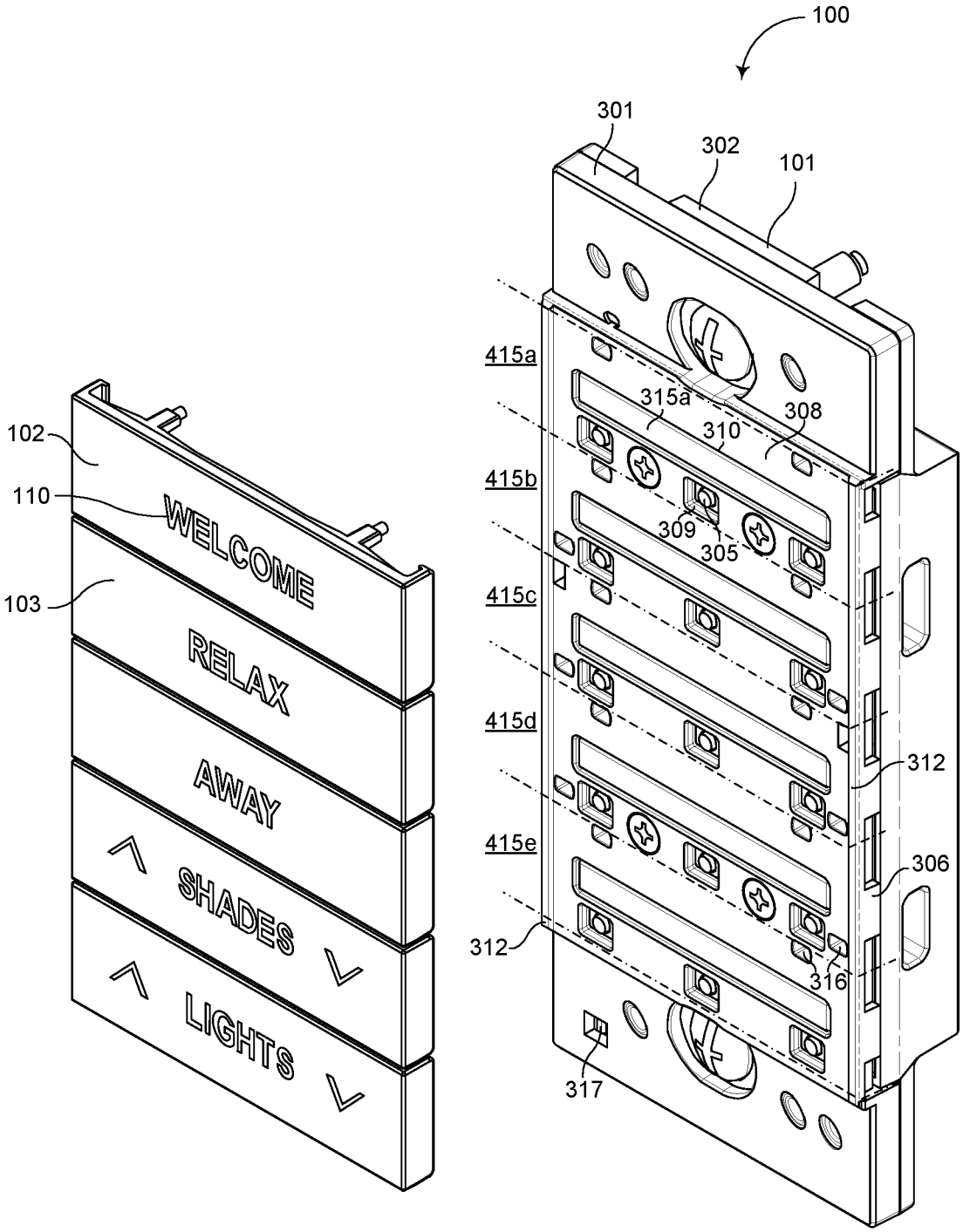

FIG. 4 illustrates a perspective view of the control device with the buttons removed according to an illustrative embodiment.

Figure 5:
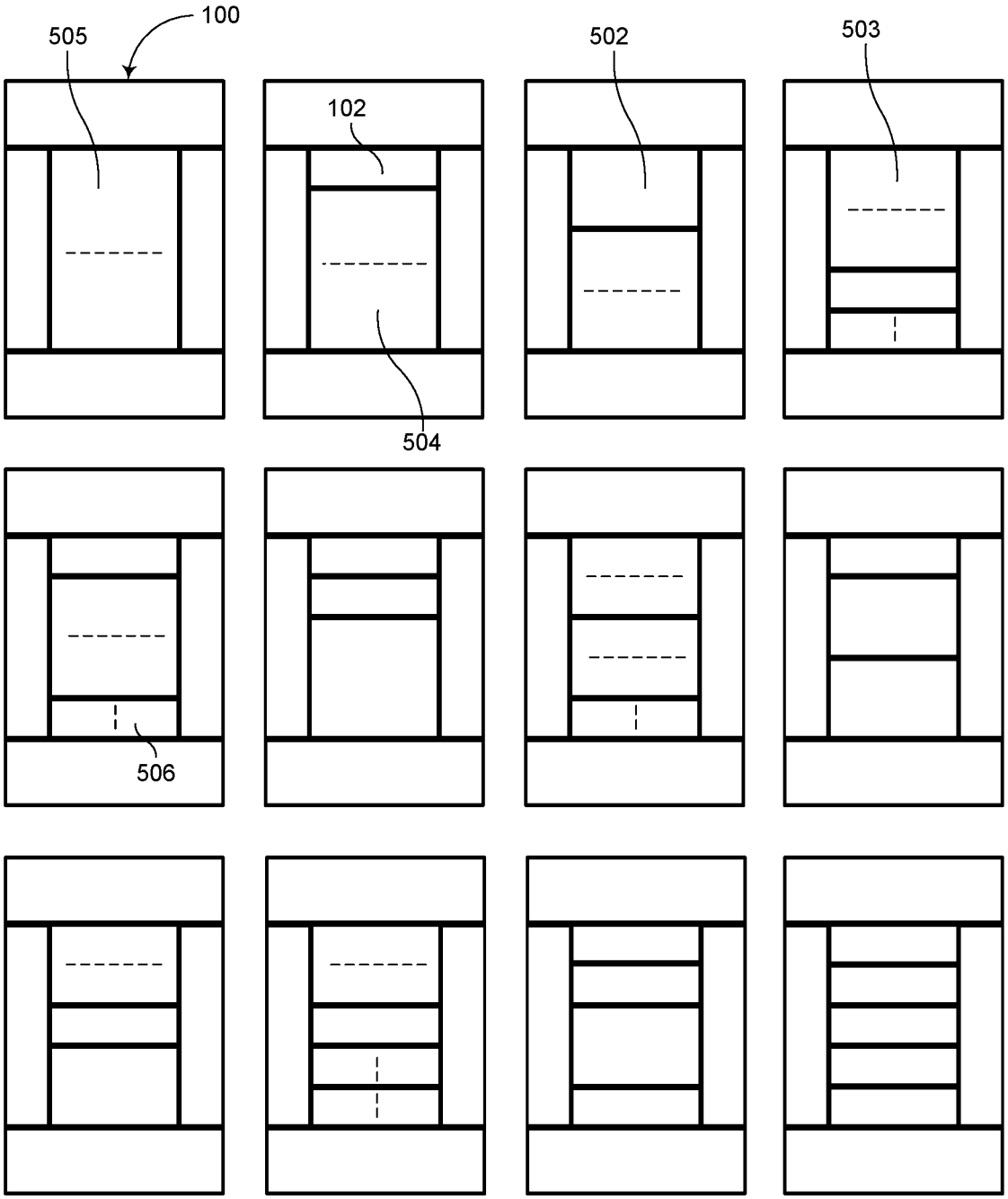

FIG. 5 illustrates various possible button configurations of the control device according to an illustrative embodiment.

Figure 6:
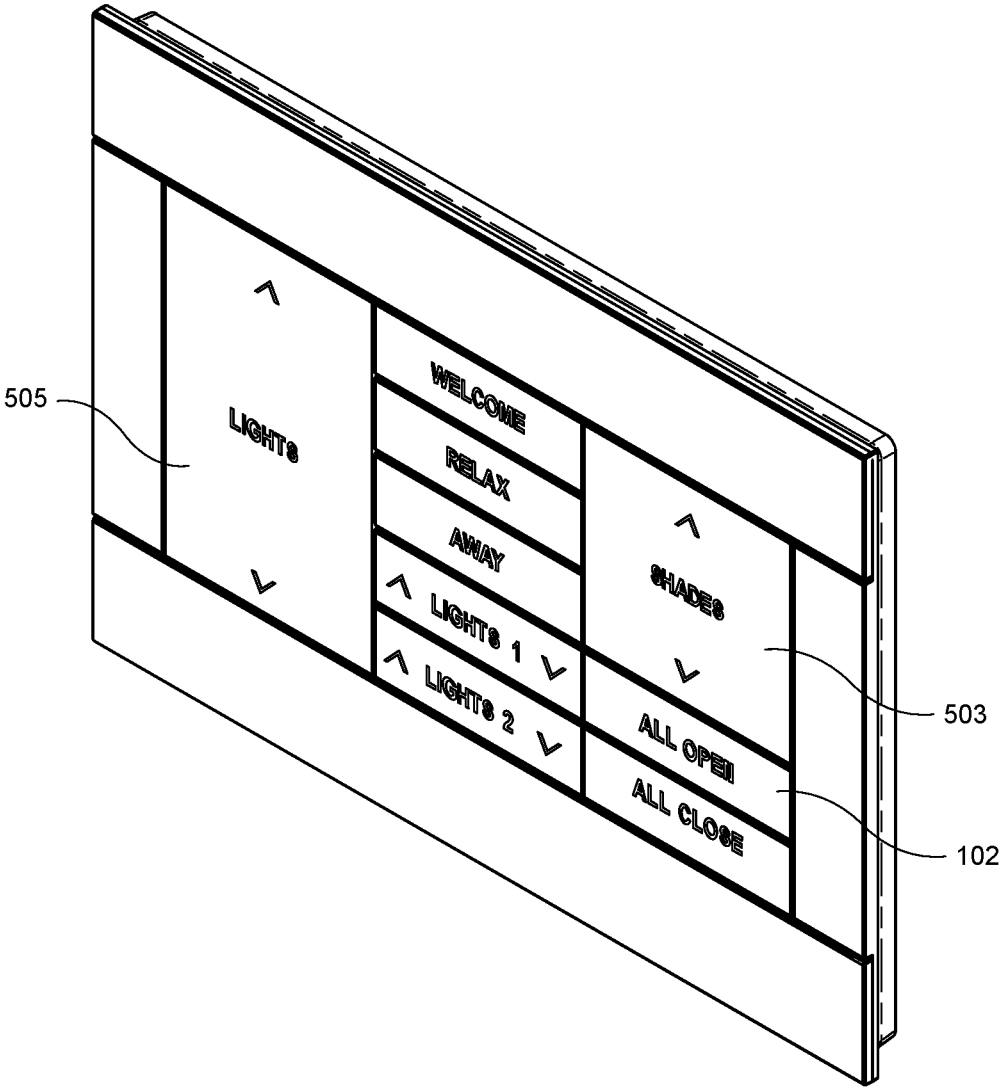

FIG. 6 illustrates a front perspective view of three ganged control devices according to an illustrative embodiment.

Figure 7:
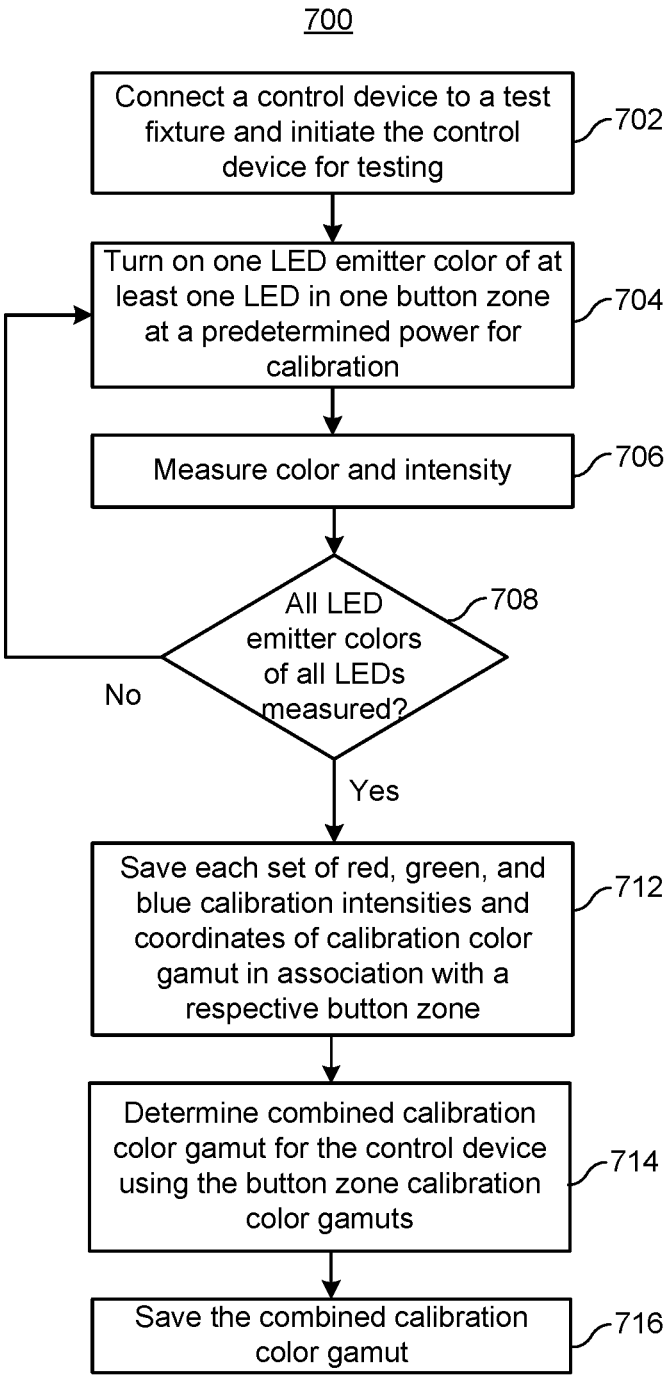

FIG. 7 shows a flowchart illustrating the steps for obtaining calibration data for the control device according to an illustrative embodiment.

Figure 8:
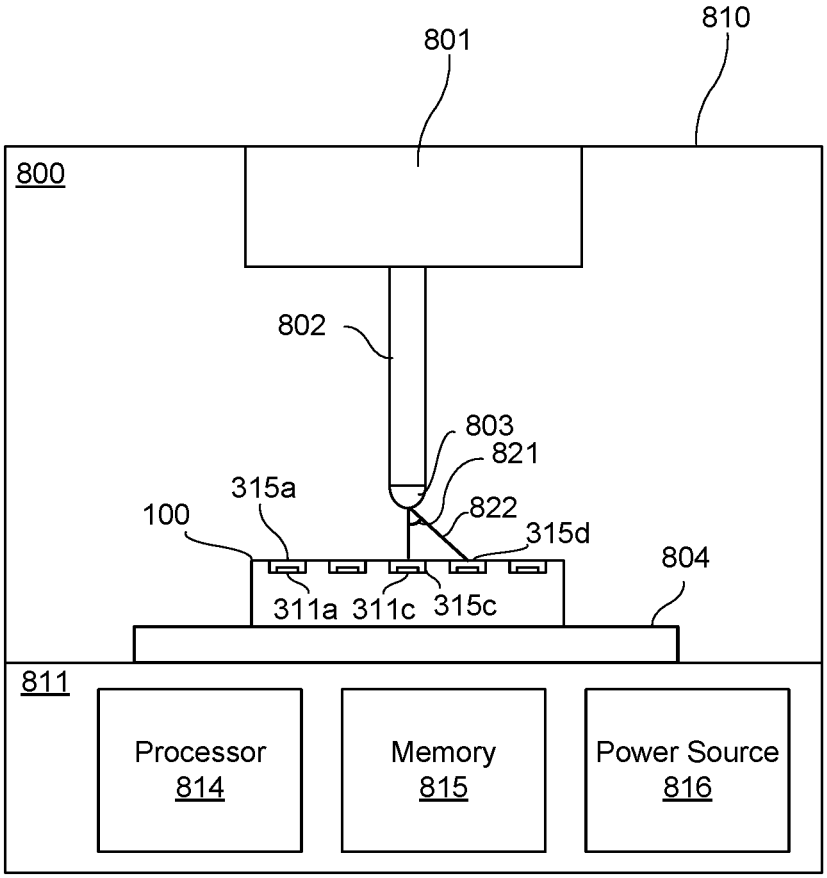

FIG. 8 illustrates a test fixture for obtaining calibration data for the backlight LEDs of the control device according to an illustrative embodiment.

Figure 9:
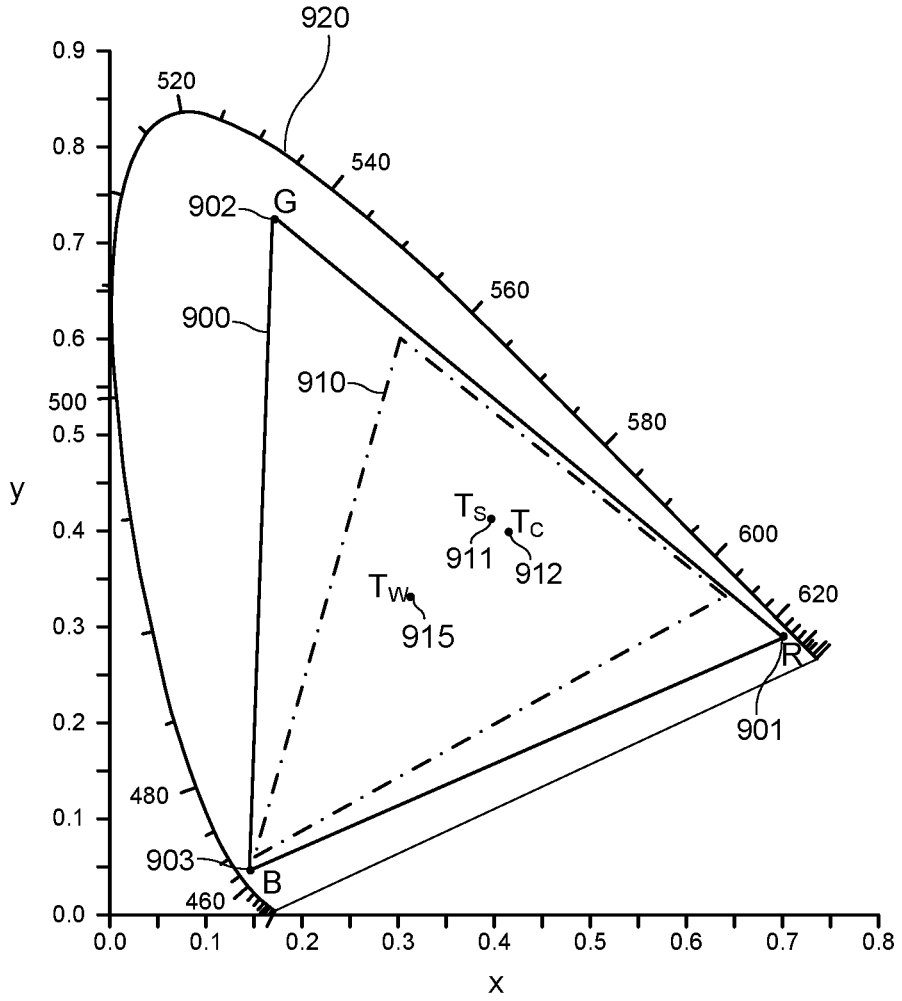

FIG. 9 illustrates a CIE xy chromaticity diagram of the CIE 1931 color space according to an illustrative embodiment.

Figure 10:
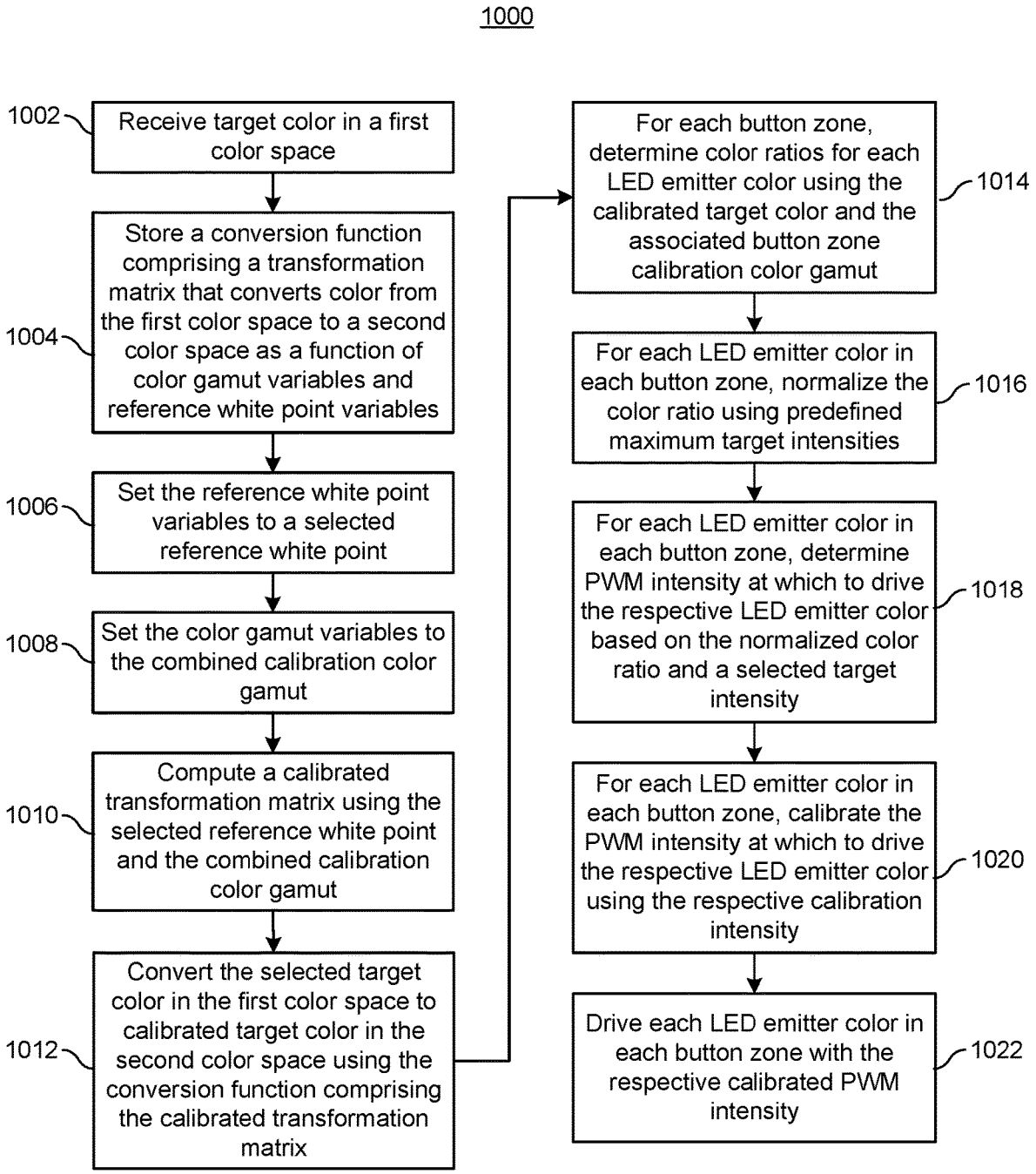

FIG. 10 shows a flowchart illustrating the steps for determining a plurality of calibrated PWM intensity levels, each used to drive a respective LED emitter color of at least one LED in a button zone according to an illustrative embodiment.

Figure 11:
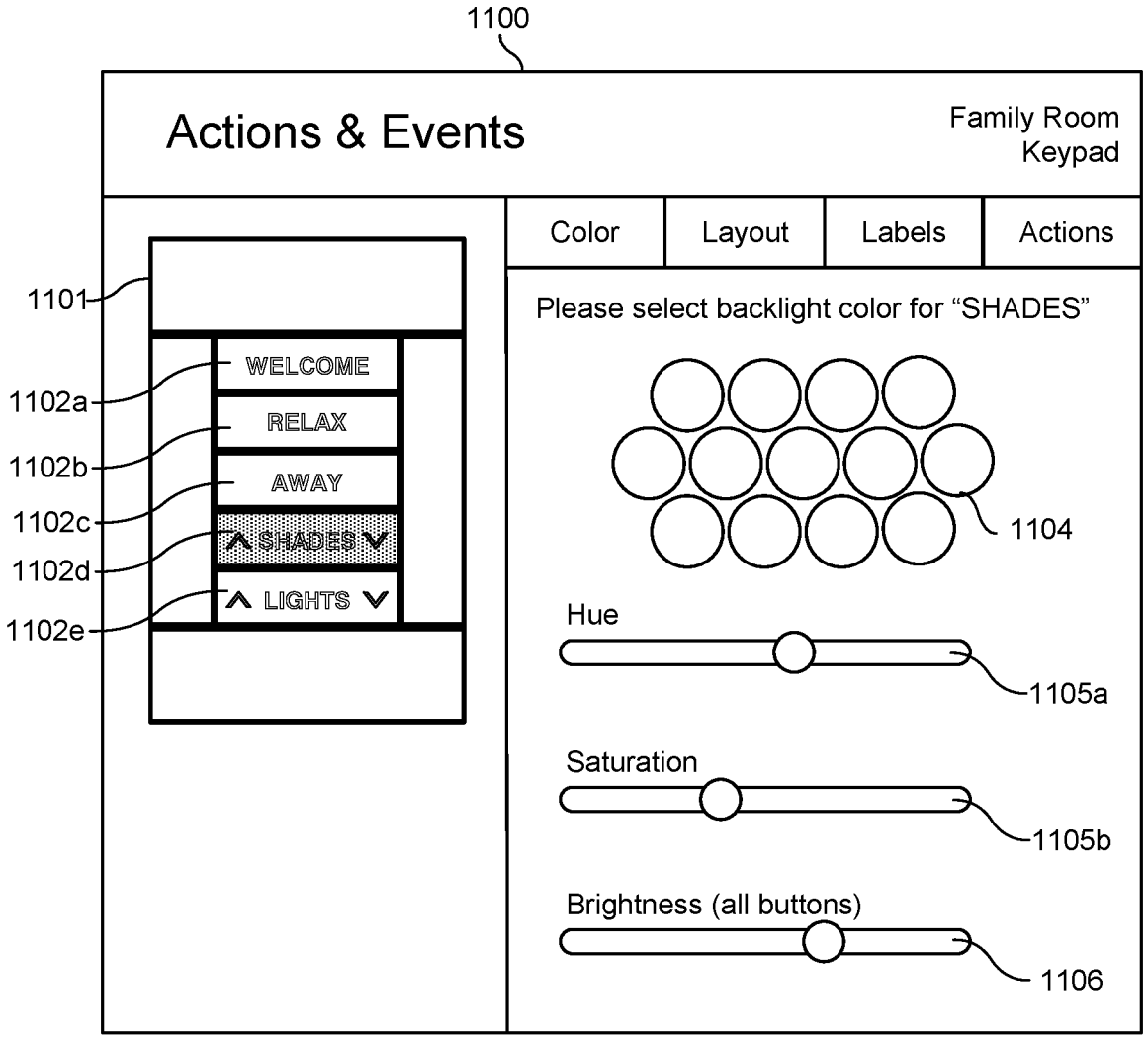

FIG. 11 illustrates an exemplary user interface for selecting a target color according to an illustrative embodiment.

Figure 12:
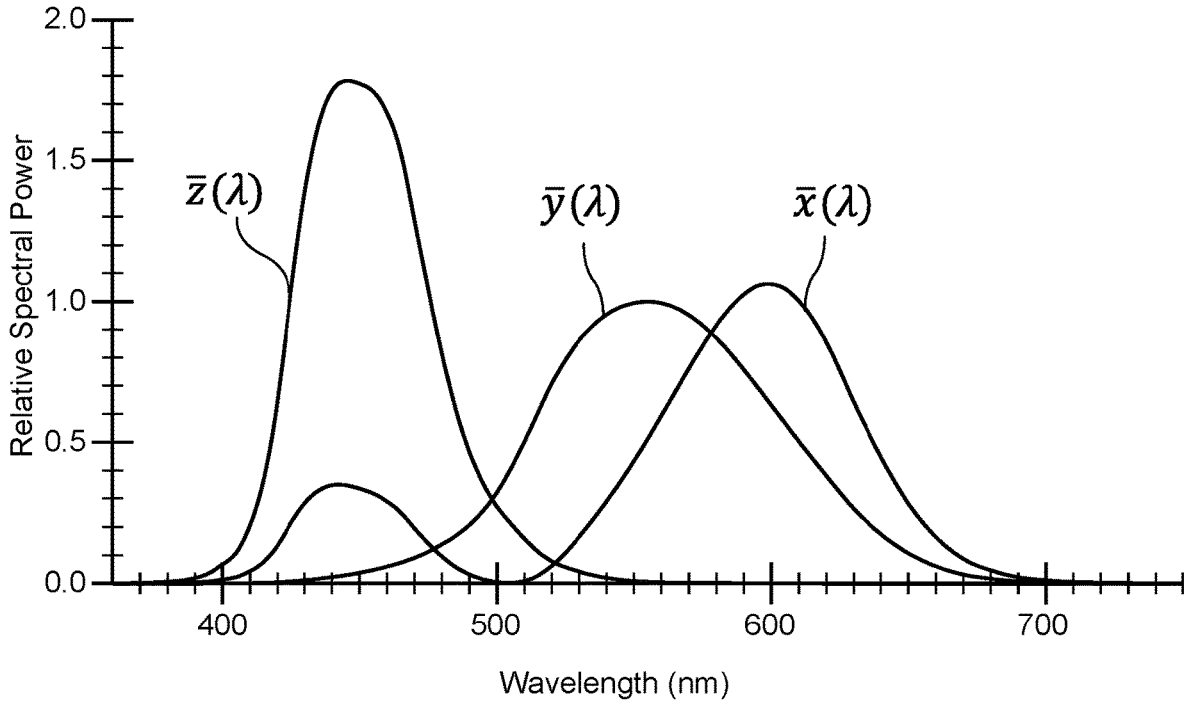

FIG. 12 illustrates the CIE XYZ standard observer color matching functions according to an illustrative embodiment.

Figure 13:
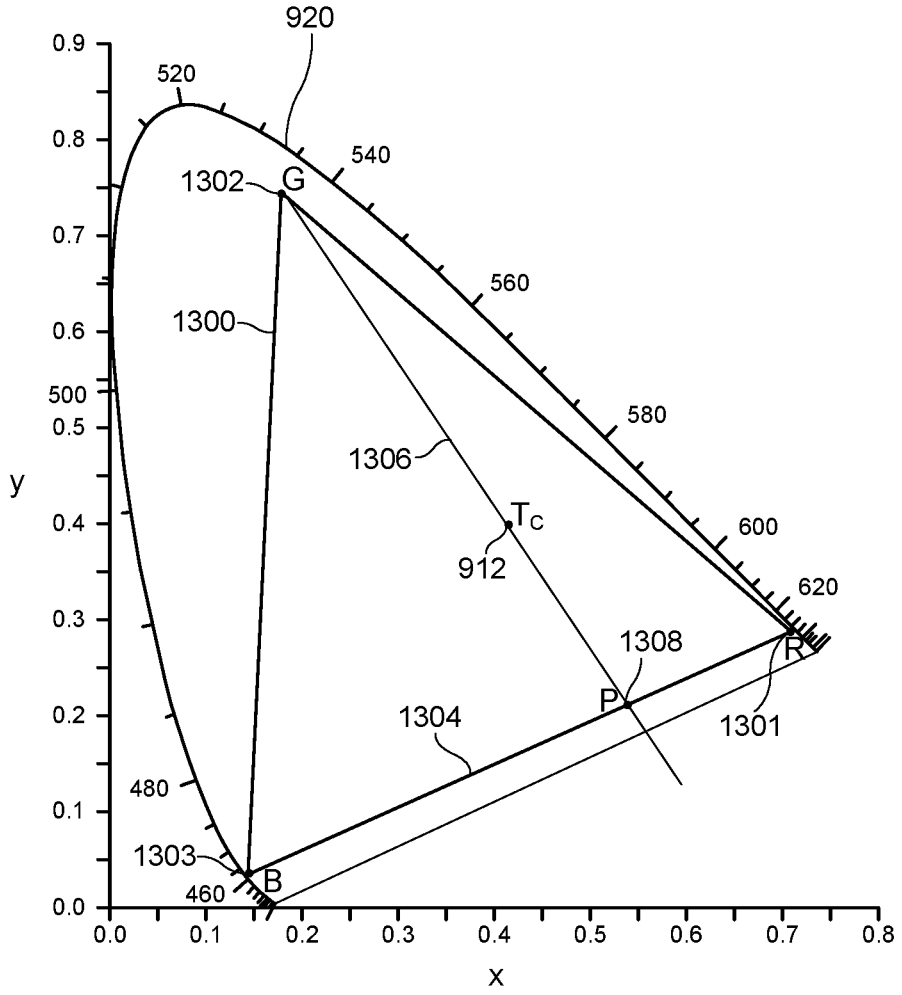

FIG. 13 illustrates a chromaticity diagram of an exemplary calibration color gamut of a single button zone according to an illustrative embodiment.

Figure 14:
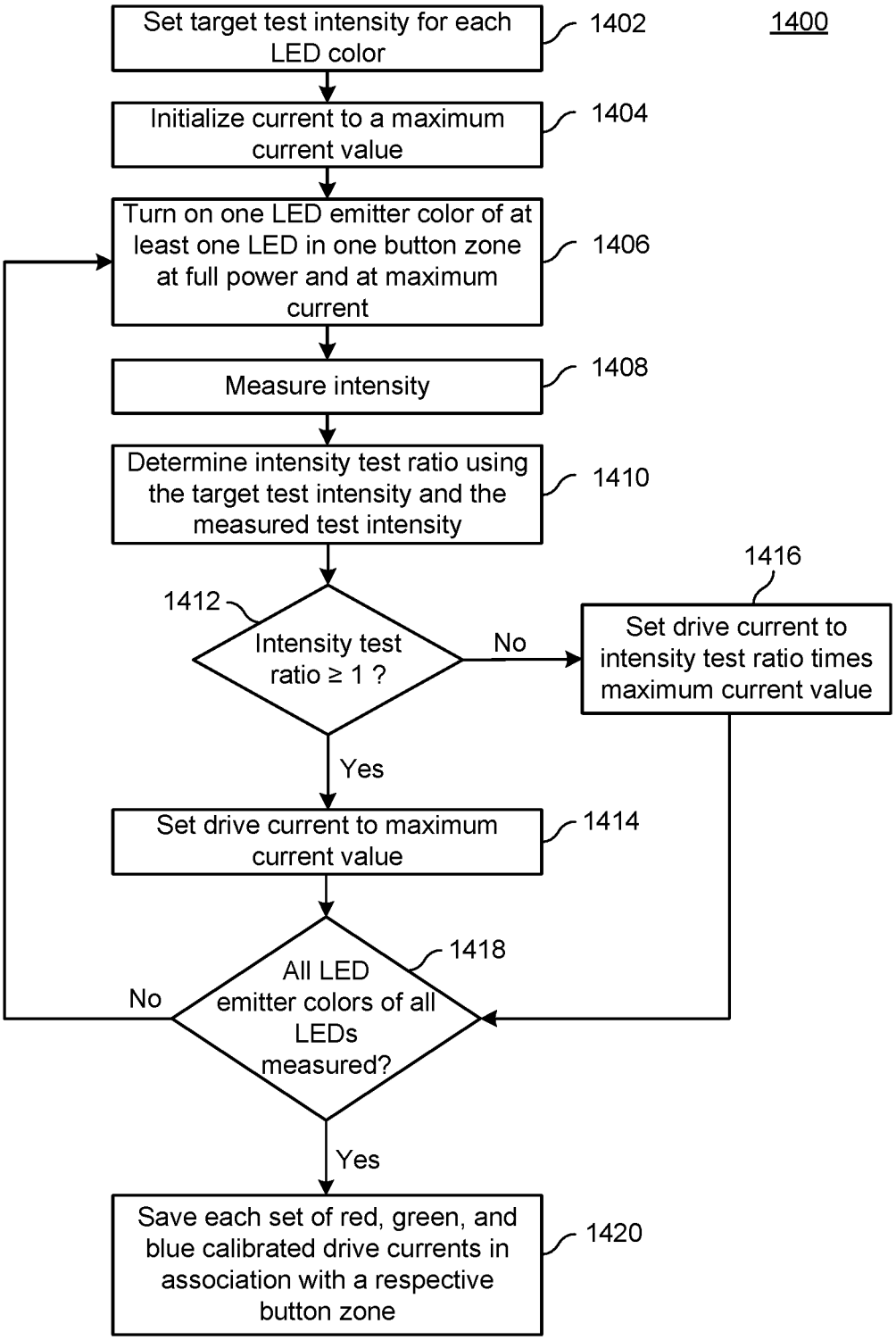

FIG. 14 shows a flowchart illustrating the steps for determining calibrated drive current values for each LED emitter color of at least one LED in each button zone.

DETAILED DESCRIPTION OF THE INVENTION

The embodiments are described more fully hereinafter with reference to the accompanying drawings, in which embodiments of the inventive concept are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the inventive concept to those skilled in the art. The scope of the embodiments is therefore defined by the appended claims. The detailed description that follows is written from the point of view of a control systems company, so it is to be understood that generally the concepts discussed herein are applicable to various subsystems and not limited to only a particular controlled device or class of devices.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" or "in an embodiment" in various places throughout the specification is not necessarily referring to the same embodiment. Further, the particular feature, structures, or characteristics may be combined in any suitable manner in one or more embodiments.

LIST OF REFERENCE NUMBERS FOR THE ELEMENTS IN THE DRAWINGS IN NUMERICAL ORDER

The following is a list of the major elements in the drawings in numerical order.

100 Control Device
101 Housing
102 Buttons
103 Front Surface
106 Faceplate
108 Opening
110 Indicia
202 Vertical Side Walls
203 Horizontal Top Wall
204 Horizontal Bottom Wall
205 Decorative Front Surface
207 Shoulders
209 Trim Plate
210 Front Surface
211 Mounting Holes
212 Screws
213 Screws
217 Opening
218 Lens
301 Front Housing Portion
302 Rear Housing Portion
304 Printed Circuit Board (PCB)
305 Tactile Switches
306 Side Walls
307 Screws
308 Front Wall
309 Openings
310 Openings
311*a-e* Light Sources/Light Emitting Diodes (LEDs)
312 Rails
314 Side Edges
315*a-e* Light Bars
316 Orifices
317 Light Sensor
318 Orifices
415*a-e* Button Zones
502 Two Height Button
503 Three Height Button
504 Four Height Button
505 Five Height Button
506 One Height Rocker Button
700 Flowchart Illustrating the Steps for Obtaining Calibration Data for the Control Device
702-716 Steps of Flowchart 700
800 Test Fixture
801 Spectrometer
802 Optical Fiber
803 Lens
804 Base
810 Enclosure
811 Testing Computer
814 Processor
815 Memory

816 Power Source
821 Angle
822 Distance
900 Combined Calibration Color Gamut
901 Red Coordinates
902 Green Coordinates
903 Blue Coordinates
910 sRGB Color Gamut
911 Selected Target Color
912 Calibrated Target Color
915 Target White Point
920 XYZ Color Space
1000 Flowchart Illustrating the Steps for Determining a Plurality of
Calibrated PWM Intensity Levels Each Used to Drive a Respective
LED Emitter Color of at least one LED In a Button Zone
1002-1022 Steps of Flowchart 1000
1100 User Interface
1101 Representation of the Control Device
1102*a-e* Selectable Buttons
1104 Selectable Color Fields
1105*a* Hue Selection Slider
1105*b* Saturation Selection Slider
1106 Brightness Selection Slider
1300 Calibration Color Gamut
1301 Red Coordinate
1302 Green Coordinate
1303 Blue Coordinate
1304 Line Between Red Coordinate and Blue Coordinate
1306 Line Between Green Coordinate and Calibrated Target Color
1308 Intercept Between Line 1304 and Line 1306
1400 Flowchart Illustrating the Steps for Determining Calibrated Drive Current Values for Each LED Emitter Color of at Least One LED in Each Button Zone
1402-1420 Steps of Flowchart 1400

LIST OF ACRONYMS USED IN THE SPECIFICATION IN ALPHABETICAL ORDER

The following is a list of the acronyms used in the specification in alphabetical order.

AC Alternating Current
AF Attenuation Factor
ASIC Application Specific Integrated Circuit
AV Audiovisual
B Blue
CIE International Commission on Illumination
$C_{linear}$ Linear RGB Values
$C_{srgb}$ sRGB Values
D Distance
DC Direct Current
G Green
HVAC Heating, Ventilation and Air Conditioning
K Kelvin
$I_{LUX}$ Measured Lux Intensity
$I_{MCD}$ Calibration MCD Intensity
IR Infrared
$I_T$ Target Intensity Value
$J_{max}$ Maximum Current Value
LED Light Emitting Diode
M Transformation Matrix
mA Milliampere
$M_C$ Calibrated Transformation Matrix
MCD Millicandela
$O_{GT}$ Offset of Line Between Green and Target Color Coordinates
$O_{RB}$ Offset of Line Between Red and Blue Coordinates
PCB Printed Circuit Board
PoE Power-over-Ethernet
PWM Pulse Width Modulation
R Red
RAM Random-Access Memory
RF Radio Frequency
RGB Red-Green-Blue
RGBW Red-Green-Blue-White
RISC Reduced Instruction Set Computer
ROM Read-Only Memory
$S_{GT}$ Slope of Line Between Green and Target Color Coordinates
SI International System of Units
sRGB Standard RGB Color Space
$S_{RB}$ Slope of Line Between Red and Blue Coordinates
$T_C$ Calibrated Target Color Point
$T_S$ Selected Target Color Point
$T_W$ Target White Point
Θ Angle
γ Gamma Correction
$x_{Rmin}$ Minimum Red x Value
$x_{Gave}$ Average Green x Value
$x_{Bmax}$ Maximum Blue x Value
$y_{Rave}$ Average Red y Value
$y_{Gmin}$ Minimum Green y Value
$y_{Bmax}$ Maximum Blue y Value
($F_{NR}$, $F_{NG}$, $F_{NB}$) Red, Green, Blue Normalized Color Ratios
($F_R$, $F_G$, $F_B$) Red, Green, Blue Color Ratios
($F_{Ri}$, $F_{Gi}$, $F_{Bi}$) Red, Green, Blue Normalizing Intensity Ratios
($F_{Rc}$, $F_{Gc}$, $F_{Bc}$) Red, Green, Blue Calibration Intensity Ratios
($F_{Rt}$, $F_{Gt}$, $F_{Bt}$) Red, Green, Blue Intensity Test Ratios
($I_{Ri}$, $I_{Gi}$, $I_{Bi}$) Red, Green, Blue Maximum Target Intensity Values
($I_{Rt}$, $I_{Gt}$, $I_{Bt}$) Red, Green, Blue Target Test Intensities
($I_{Rm}$, $I_{Gm}$, $I_{Bm}$) Red, Green, Blue Measured Intensities
($I_{R1 \ldots n}$, $I_{G1 \ldots n}$, $I_{B1 \ldots n}$) Calibration Intensity Values
($J_R$, $J_G$, $J_B$) Red, Green, Blue Drive Current Values
($J_{R1 \ldots n}$, $J_{G1 \ldots n}$, $J_{B1 \ldots n}$) Calibrated Drive Current Values
($PWM_R$, $PWM_G$, $PWM_B$) Red, Green, Blue PWM Intensity Values
($PWM_{CR}$, $PWM_{CG}$, $PWM_{CB}$) Red, Green, Blue Calibrated PWM Intensity Values
($R_{TS}$, $G_{TS}$, $B_{TS}$) Linear RGB Target Color
($sR_{TS}$, $sG_{TS}$, or $sB_{TS}$) sRGB Target Color Values
($X_{TC}$, $Y_{TC}$, $Z_{TC}$) Calibrated XYZ Target Color Values
($x_R$, $y_R$) Red Color Coordinates
($x_G$, $y_G$) Green Color Coordinates
($x_B$, $y_B$) Blue Color Coordinates
($x_{R1 \ldots n}$, $y_{R1 \ldots n}$) Calibration Color Coordinates of Red Emitters
($x_{G1 \ldots n}$, $y_{G1 \ldots n}$) Calibration Color Coordinates of Green Emitters
($x_{B1 \ldots n}$, $y_{B1 \ldots n}$) Calibration Color Coordinates of Blue Emitters
($x_{CR}$, $y_{CR}$) Combined Calibration Color Coordinates of Red Emitters
($x_{CG}$, $y_{CG}$) Combined Calibration Color Coordinates of Green Emitters
($x_{CB}$, $y_{CB}$) Combined Calibration Color Coordinate of Blue Emitters $(x_P, y_P)$ Coordinates of the Purple Point
$(x_T, y_T)$ Coordinates of the Calibrated Target Color
$(X_W, Y_W, Z_W)$ White Point Coordinates

Mode(S) for Carrying Out the Invention

For 40 years Crestron Electronics, Inc. has been the world's leading manufacturer of advanced control and automation systems, innovating technology to simplify and enhance modern lifestyles and businesses. Crestron designs, manufactures, and offers for sale integrated solutions to control audio, video, computer, and environmental systems. In addition, the devices and systems offered by Crestron streamlines technology, improving the quality of life in commercial buildings, universities, hotels, hospitals, and homes, among other locations. Accordingly, the systems, methods, and modes of the aspects of the embodiments described herein can be manufactured by Crestron Electronics, Inc., located in Rockleigh, N.J.

The different aspects of the embodiments described herein pertain to the context of wall mounted control devices, but are not limited thereto, except as may be set forth expressly in the appended claims. Particularly, the aspects of the embodiments are related to an apparatus, system, and method for the calibration of backlight LEDs of wall mounted control device buttons to achieve color uniformity and to accurately create colors that are consistent from button to button and device to device. To achieve the color uniformity in color and brightness, including for white, that is required for a quality product, the present embodiments implement a calibration procedure described in greater detail below.

Referring to FIG. 1, there is shows a perspective front view of an illustrative wall mounted control device 100 according to an illustrative embodiment. The control device 100 may serve as a user interface to associated loads or load controllers in a space. According to an embodiment, the control device 100 may be configured as a keypad comprising a plurality of buttons, such as five single height buttons 102. Each button 102 may be associated with a particular load and/or to a particular operation of a load. For example, different buttons 102 may correspond to different lighting scenes of lighting loads. However, other button configuration may be used. According to various embodiments, the control device 100 may be configured as a lighting switch or a dimmer having a single button that may be used to control an on/off status of the load. Alternatively, or in addition, the single button can be used to control a dimming setting of the load.

In an illustrative embodiment, the control device 100 may be configured to receive control commands from a user via buttons 102 and either directly or through a control processor transmit the control command to a load (such as a light, fan, window blinds, etc.) or to a load controller (not shown) electrically connected to the load to control an operation of the load based on the control commands. In various aspects of the embodiments, the control device 100 may control various types of electronic devices or loads. The control device 100 may comprise one or more control ports for interfacing with various types of electronic devices or loads, including, but not limited to audiovisual (AV) equipment, lighting, shades, screens, computers, laptops, heating, ventilation and air conditioning (HVAC), security, appliances, and other room devices. The control device 100 may be used in residential load control, or in commercial settings, such as classrooms or meeting rooms.

Each button 102 may comprise indicia 110 disposed thereon to provide clear designation of each button's function. Each button 102 may be backlit, for example via light emitting diodes (LEDs), for visibility and/or to provide status indication of the button 102. For example, buttons 102 may be backlit by white, blue, or another color LEDs. In addition, different buttons 102 may be backlit via different colors, for example, to distinguish between buttons, load types (e.g., emergency load), or the load state (e.g., on, off, or selected scene), AV state (e.g., selected station or selected channel), or button backlight colors may be chosen to complement the surroundings or to give a pleasing visual effect. Buttons 102 may comprise opaque material while the indicia 110 may be transparent or translucent allowing light from the LEDs to pass through the indicia 110 and be perceived from the front surface 103 of the button 102. The indicia 110 may be formed by engraving, tinting, printing, applying a film, etching, and/or similar processes.

Reference is now made to FIGS. 1 and 2, where FIG. 2 shows the control device 100 with the faceplate 106 removed. The control device 100 may comprise a housing 101 adapted to house various electrical components of the control device 100, such as the power supply and an electrical printed circuit board (PCB) 304 (FIG. 3). The housing 101 is further adapted to carry the buttons 102 thereon. The housing 101 may comprise mounting holes 211 for mounting the control device 100 to a standard electrical box via screws 212. According to another embodiment, control device 100 may be mounted to other surfaces using a dedicated enclosure. According yet to another embodiment, the control device 100 may be configured to sit freestanding on a surface, such as a table, via a table top enclosure. Once mounted to a wall or an enclosure, the housing 101 may be covered using a faceplate 106. The faceplate 106 may comprise an opening 108 sized and shaped for receiving the buttons 102 therein. The faceplate 106 may be secured to the housing 101 using screws 213. The screws 213 may be concealed using a pair of decorative trim plates 209, which may be removably attached to the faceplate 106 using magnets (not shown). However, other types of faceplates may be used.

Referring now to FIG. 3, which illustrates an exploded view of the control device 100. Housing 101 of control device 100 may comprise a front housing portion 301 and a rear housing portion 302. The rear housing portion 302 may fit within a standard electrical or junction box and may be adapted to contain various electrical components, for example on a printed circuit board (PCB) 304, configured for providing various functionality to the control device 100, including for receiving commands and transmitting commands wirelessly to a load or a load controlling device. The rear housing portion 302 may house a power supply (not shown) for providing power to the various circuit components of the control device 100. The control device 100 may be powered by an electric alternating current (AC) power signal from an AC mains power source or via DC voltage. Such control device 100 may comprise leads or terminals suitable for making line voltage connections. In yet another embodiment, the control device 100 may be powered using Power-over-Ethernet (PoE) or via a Cresnet® port. Cresnet® provides a network wiring solution for Creston® keypads, lighting controls, thermostats, and other devices. The Cresnet® bus offers wiring and configuration, carrying bidirectional communication and 24 VDC power to each device over a simple 4-conductor cable. However, other types of connections or ports may be utilized.

The printed circuit board 304 may include a controller comprising one or more processors, memories, communication interfaces, or the like. The processor can represent one or more microprocessors, such as "general purpose" microprocessors, a combination of general and special purpose microprocessors, or application specific integrated circuits (ASICs). Additionally, or alternatively, the processor can include one or more reduced instruction set (RISC) processors, video processors, or related chip sets. The processor can provide processing capability to execute an operating system, run various applications, and/or provide processing for one or more of the techniques and functions described herein. The memory may be communicably coupled to the processor and can store data and executable code. The memory can represent volatile memory such as random-access memory (RAM), and/or nonvolatile memory, such as read-only memory (ROM) or Flash memory. In buffering or caching data related to operations of the processor, the memory can store data associated with applications running on the processor.

The one or more communication interfaces on PCB 304 may comprise a wired or a wireless communication interface, configured for transmitting control commands to various connected loads or electrical devices, and receiving feedback. A wireless interface may be configured for bidirectional wireless communication with other electronic devices over a wireless network. In various embodiments, the wireless interface can comprise a radio frequency (RF) transceiver, an infrared (IR) transceiver, or other communication technologies known to those skilled in the art. In one embodiment, the wireless interface communicates using the infiNET EX® protocol from Crestron Electronics, Inc. of Rockleigh, N.J. infiNET EX® is an extremely reliable and affordable protocol that employs steadfast two-way RF communications throughout a residential or commercial structure without the need for physical control wiring. In another embodiment, communication is employed using the ZigBee® protocol from ZigBee Alliance. In yet another embodiment, the wireless communication interface may communicate via Bluetooth transmission. A wired communication interface may be configured for bidirectional communication with other devices over a wired network. The wired interface can represent, for example, an Ethernet or a Cresnet® port. In various aspects of the embodiments, control device 100 can both receive the electric power signal and output control commands through the PoE interface.

The front surface of the PCB 304 may comprise a plurality of micro-switches or tactile switches 305. For example, the PCB 304 may contain fifteen tactile switches 305 arranged in three columns and five rows to accommodate various number of button configurations. However, other number of switches and layouts may be utilized to accommodate other button configurations. The tactile switches 305 are adapted to be activated via buttons 102 to receive user input.

The PCB 304 may further comprise a plurality of light sources 311*a-e* configured for providing backlighting to corresponding buttons 102. Each light source 311*a-e* may comprise a multicolored light emitting diode (LED), such as a red-green-blue LED (RGB LED), comprising of red, green, and blue LED emitters in a single package. Each red, green, and blue LED emitter can be independently controlled at a different intensity. The plurality of LEDs 311*a-e* may be powered using LED drivers located on PCB 304. According to an embodiment, each red, green, and blue LED emitter can be controlled using pulse width modulation (PWM) signal with a constant current LED driver with output values ranging between 0 and 65535 for a 16-bit channel—with 0 meaning fully off and 65535 meaning fully on. Varying these PWM values of each of the red, green, and blue LED emitters on each LED 311*a-e* allows the LED 311*a-e* to create any desired color within the device's color gamut. According to an embodiment, a pair of LEDs 311*a-e* may be located on two opposite sides of each row of tactile switches 305.

The PCB 304 may further comprise a light sensor 317 configured for detecting and measuring ambient light. Light sensor 317 may be used to control the intensity levels of the light sources 311*a-e* based on the measured ambient light. According to an embodiment, light sensor 317 may impact the brightness levels of LEDs 311*a-e* to stay at the same perceived level with respect to the measured ambient light levels. A light curve may be used to adjust the brightness of LEDs 311*a-e* based on measured ambient light levels by the light sensor 317. According to another embodiment, threshold values may be used. According to yet another embodiment, light sensor 317 may impact the color or on/off state of the LEDs 311*a-e* based on the measured ambient light levels. Referring to FIG. 2, the faceplate 106 may comprise an opening 217 adapted to contain a lens 218. Lens 218 may direct ambient light from a bottom edge of the faceplate 106 toward the light sensor 317. The lens 218 may be hidden from view by the trim plate 209. The PCB 304 may comprise other types of sensors, such as motion or proximity sensors.

Referring back to FIG. 3, the control device 100 may further comprise a plurality of horizontally disposed rectangular light pipes or light bars 315*a-e* each adapted to be positioned adjacent a respective row of tactile switches 305 and between a respective pair of LEDs 311*a-e*. For example, each light bar 315*a-e* may be positioned above a respective row of tactile switches 305, as shown in FIG. 4. According to one embodiment, the light bars 315*a-e* may be individually attached to the front surface of the PCB 304, for example, using an adhesive. According to another embodiment, the light bars 315*a-e* may be interconnected into a single tree structure as shown in FIG. 3 and adapted to be attached within the housing 101 via screws 307. Each light bar 315*a-e* is configured for distributing and diffusing light from the respective pair of LEDs 311*a-e* to an individual button 102 for uniform illumination as well as reduced shadowing and glare. Light bars 315*a-e* may be fabricated from optical fiber or transparent plastic material such as acrylic, polycarbonate, or the like. Each pair of oppositely disposed LEDs 311*a-e* may extend out of the front surface of the PCB 304 and may be configured to direct light to opposite side edges 314 of a respective light bar 315*a-e*. As such, when a pair of LEDs 311*a-e* are turned on, light is distributed by the light bar 315*a-e* from its side edges 314 and out of its front surface to be directed through the indicia 110 of the respective button 102.

The front housing portion 301 is adapted to be secured to the rear housing portion 302 using screws 307 such that the PCB 304 and light bars 315*a-e* are disposed therebetween. The front housing portion 301 comprises a front wall 308 with a substantially flat front surface. The front wall 308 may comprise a plurality of openings 309 extending traversely therethrough aligned with and adapted to provide access to the tactile switches 305 as shown in FIG. 4. Front wall 308 may further comprise rectangular horizontal openings 310 extending traversely therethrough aligned with and sized to surround at least a front portion of a respective light bar 315*a-e*. The front housing portion 301 may comprise an opaque material, such as a black colored plastic or the like, that impedes light transmission through the front wall 308 to prevent light bleeding from one set of light bar 315*a-e* and corresponding light sources 311*a-e* to another set.

Referring to FIG. 4, there is shown a perspective view of the control device 100 with the buttons 102 removed. The control device 100 may define a plurality of button zones 415*a-e* adapted to receive a plurality of rows of different height buttons. Particularly, each button zone 415*a-e* may be configured to receive a single height button 102. For example, the control device 100 is shown containing five button zones 415*a-e* adapted to receive five single height buttons, but it may comprise any other number of button zones. According to an embodiment, each button zone 415*a-e* comprises a row of one or more tactile switches 305, one or more button alignment orifices 316, a light bar 315*a-e*, and a pair of corresponding LEDs 311*a-e*. According to an embodiment shown in FIG. 4, each button zone 415*a-e* may comprise a row of three tactile switches 305. The two side switches 305 of each button zone 415*a-e* may be used for a left/right rocker function, while the center switch 305 of each button zone 415*a-e* may be used for a single press button or be part of an up/down rocker function. In addition, backlighting of each button zone 415*a-e* may be independently controllable. Because the button zones 415*a-e* are isolated and masked using the front housing portion 301, backlighting of one zone does not bleed into the adjacent zones. Additionally, each light bar 315*a-e* is adapted to be disposed in substantially the center of the respective button zone 415*a-e* and comprises a width that spans substantially the width of the front wall 308 of the front housing portion 301 such that the indicia 110 on the corresponded button 102 is backlighted evenly.

Referring to FIG. 5, two or more button zones 415*a-e* may be combined to receive a multi-zone height button, such as a two-zone height button 502, a three-zone height button 503, a four-zone height button 504, or a five-zone height button 505. According to another embodiment, a one zone height button may comprise a rocker button 506. As such, the control device 100 of the present embodiments may interchangeably receive various multi-zone height buttons to provide a vast number of possible configurations, as required by an application, some of which are shown in FIG. 5. Other button assembly configurations are also contemplated by the present embodiments. Additionally, depending on which tactile switches 305 are exposed by a button, the various single or multi-zone button heights may be configured to operate as a single press button, a left/right rocker, or an up/down rocker, as discussed below. According to an embodiment, the various button configurations beneficially share the same circuit board layout shown in FIG. 3 by utilizing one or more of the tactile switches 305. In addition, for buttons that span two or more button zones 415*a-e*, one or more lines of indicia 110 may be included and individually backlit, for example as shown in FIG. 6. Each line of indicia 110 may be aligned with backlighting of any one of the button zone 415*a-e*. For example, referring to FIG. 6, a three-zone height button 503 may comprise three lines of indicia, each individually backlit by a respective zone. A five-zone height button 505 may also comprise three lines of individually backlit indicia, while backlighting of zones containing no indicia may be unused.

The wall-mounted control device 100 can be configured in the field, such as by an installation technician, in order to accommodate many site-specific requirements. Field configuration can include selection and installation of an appropriate button configuration based on the type of load, the available settings for the load, etc. Advantageously, such field configurability allows an installation technician to adapt the electrical device to changing field requirements (or design specifications). Beneficially, the buttons are field replaceable without removing the device from the wall. After securing the buttons 102 on the control device 100, the installer may program the button configuration through tapping all of the placed buttons. The configured buttons can then be assigned to a particular load or function.

In order to accurately create backlight colors that are consistent from button to button of each unit as well as from unit to unit in both brightness and color reproduction, the present embodiments provide for an apparatus, system, and method for the calibration of the backlight LEDs 311*a-e* of the buttons 102 of the wall mounted control device 100 to achieve color uniformity and to accurately create colors that are substantially consistent from button to button and device to device. The calibration method of the present embodiments also allows the use of one or more RGB LEDs 311*a-e* for each button to both produce white and color backlighting—without the use of additional white tunable LEDs, such as RGBW LEDs. It should be understood, however, that while the present embodiments provide for calibration of LEDs of control device 100 illustrated in FIG. 1, the calibration procedure may be applied to control devices of other configuration, as well as other types of electronic devices that contain RGB LEDs light indicators or backlighting, without departing from the scope of the present embodiments, such as appliances, remote controls, dash boards, or the like.

Referring to FIG. 7, there is shown a flowchart 700 illustrating the steps for obtaining calibration data for the control device 100 according to an illustrative embodiment. Calibration data for each manufactured control device 100 may be obtained substantially at the end of line in production according to the method of the present embodiments. In step 702, the control device 100 that is to be tested may be placed in and connected to a test fixture 800 for LED calibration. Referring to FIG. 9, there is shown a test fixture 800, which may comprise an enclosure 810, a base 804, a spectrometer 801, and a testing computer 811. Testing computer 811 may comprise a processor 814, a memory 815, and a power source 816. The base 804 may be adapted to electrically connect the control device 100 to the testing computer 811, for example via wire leads or a terminal block, and to place the center of the front of the control device 100 to be tested at for example approximately 2.5" from the spectrometer 801 within enclosure 810. The control device 100 is placed in and tested by the test fixture 800 before attaching the buttons 102 to the device housing 101 such that the light bars 315*a-e* are fully visible as shown in FIG. 4. The buttons 102 may be connected to the control device 100 after testing or in the field when installing the device 100. Enclosure 810 may be adapted to isolate the test device 100 from outside environment and place the control device 100 in a substantially dark environment for testing. The spectrometer 801 may comprise calibrated spectrometer having a cosine lens 803 that is coupled to the spectrometer 801 via an optical fiber 802. Lens 803 allows the spectrometer 801 to capture light at up to 180 degrees field of view. Spectrometer 801 may comprise hundreds or thousands of channels adapted to detect the spectral power of the light emitted from LEDs 311*a-e* at different wavelengths such that substantially an entire power distribution spectrum of the LEDs 311*a-e* can be captured. However, other types of testing systems, such as a camera system, could be used instead of a spectrometer method illustrated in FIG. 8. In step 702, after being connected to the test fixture 800, the control device 100 is also initiated for testing by turning off all of its LEDs 311*a-e*.

As discussed above, each LED 311*a-e* comprises three LED emitter colors, including a combination of a red, green, and blue LED emitters. In step 704, the test fixture 800 turns on one LED emitter color (i.e., one of the red, green, or blue LED emitters) of at least one LED 311*a-e* in one button zone 415*a-e* for calibration—in other words, at least one LED 311*a-e* is turned on one color at a time to calibrate each red, green, and blue colors of each button zone 415*a-e* separately. Each LED emitter color in each button zone 415*a-e* can be turned on at a predetermined power, such as a predefined maximum power, and at a predetermined current. Then in step 706, the spectrometer 801 measures the color and the intensity of the turned on LED emitter color of the subject LEDs 311*a-e* in one of the button zones 415*a-e*. For example, the test fixture 800 may turn on the red LED emitters of LEDs 311*a* in button zone 415*a* and measure their intensity and color.

Measured color may be represented by x,y chromaticity coordinates in the CIE 1931 color space. Although other color spaces known in the art may be used, such as the CIE 1964 or the 1976 CIELUV color spaces. Referring to FIG. 9, there is shown the CIE xy chromaticity diagram of the CIE 1931 color space defined by color gamut 920 (also called the gamut of human vision). The CIE 1931 color space 920 is represented by the CIE standard observer color matching functions that provide a mathematical relationship between the power distribution wavelengths in electromagnetic visible spectrum and an objective description of the three physiologically perceived colors in human color vision. The XYZ standard observer uses the red primary, green primary, and the blue primary, expressed as X, Y, and Z, respectively, which are called the XYZ tristimulus values. FIG. 12 illustrates the CIE XYZ standard observer color matching functions that lead to the XYZ tristimulus values. These tristimulus values can be used to represent any color and are conceptualized as amounts of three primary colors in a tri-chromatic, additive color model. The XYZ tristimulus values essentially provide a three dimensional XYZ color space that is commonly visualized by the CIE 1931 xyY color space, which comprises the Y value to define luminance and the x,y chromaticity values that define the two dimensional chromaticity space 920. The x,y chromaticity values can be derived from the XYZ tristimulus values using the following formulas:

$$x = \frac{X}{X+Y+Z} \qquad \text{Formula 1}$$

$$y = \frac{Y}{X+Y+Z}$$

Accordingly, the spectrometer 801 may sample the color of the turned on LED emitter to get the spectrum power distribution of the emitted light and it may map the sampled spectrum power distribution to the CIE color space to get the x,y color coordinates using the CIE XYZ standard observer color matching functions (FIG. 12) and Formula 1 above as is known in the art.

The spectrometer 801 may measure the intensity in Lux units, which is a unit of illuminance and luminous emittance measured as luminous flux per unit area in the International System of Units (SI). Measured Lux for each LED emitter color of each button zone 415*a-e* may be converted to Millicandela (MCD)—a unit that is commonly used to describe LED intensity—for example by using the formula shown below, which takes into account the angle distance of the LEDs 311*a-e* to the center of each light bar 315*a-e* as well as a compensation factor for light bar 315*a-e* viewing angle and LED 311*a-e* to light bar 315*a-e* output loss.

$$I_{MCD} = \left(\left(\frac{I_{Lux}}{AF} \Big/ \cos\Theta\right) \times D^2\right)1000 \qquad \text{Formula 2}$$

$I_{MCD}$ is the estimated MCD intensity that is used for the calibration intensity data. If the method is used to calibrate a pair of LEDs 311*a-e* in each button zone 415*a-b* at once, then the estimated MCD value $I_{MCD}$ is further divided by 2 (or by another number corresponding to the number of LEDs in the respective button zone). $I_{Lux}$ is the measured Lux of the LED 311*a-e* obtained by the spectrometer 801. AF is the attenuation factor of the light pipe/bar 315*a-e*, which is a constant that indicates the amount by which the light bar 315*a-e* degrades the brightness of the light coming out from the LEDs 311*a-e*. The attenuation factor (AF) can be determined by obtaining an average of a plurality of samples of light coming out of the LEDs 311*a-e* through the light bar 315*a-e* and comparing the result to the expected brightness of the LEDs 311*a-e* without the light bar 315*a-e*. The attenuation factor adjusts the intensity measurement to approximate the intensity coming out directly from the measured LED. The attenuation factor may vary depending on the type of material being used for the light bar 315*a-e* as well as its thickness. The attenuation factor (AF) varies for each button zone position, but can be constant when using a plurality of spectrometers for each button zone position. In control devices not using a light bar 315*a-e* and when the LED is pointing directly at the lens of the spectrometer, the attenuation factor may be set to 1. The test fixture 800 may store a single or a plurality of attenuation factors, as applicable, that it may use for testing control devices 100.

D is the distance from lens 803 to the center of a light pipe/bar 315*c* that is being measured in meters. Angle Θ is the angle between lens 803 and the center of the light bar 315*a-e* that is being measured in Radians to compensate for the cosine lens 803. Referring to FIG. 8, for light bar 315*c* located in the center directly below lens 803, the angle Θ will be zero. The angle Θ and distance D will increase for light bars 315*a-e* and associated LEDs 311*a-e* that are offset from the lens 803—for example, resulting in angle 821 and distance 822 for light bar 315*d* in FIG. 8. The test fixture 800 may store five constant angle Θ values and five constant distance D values for each light bar location. For control devices without a light bar 315*a-e*, the angle Θ and the distance D will be measured with respect to the LEDs 311*a-e*. According to another embodiment, instead of using a single spectrometer and determining an angle Θ and distance D for each light bar 315*a-e* in each button zone 415*a-e*, test fixture 800 may comprise a plurality of spectrometers corresponding to the number of LEDs 311*a-e* or corresponding to the number of button zones 415*a-e* (for example, five spectrometers each for each button zone 415*a-e* of control device 100). Each such spectrometer may be adapted to be positioned directly above a respective light bar 315*a-e*. This will allow for more accurate and faster readings.

In step 708, the test fixture 800 determines whether all of the emitter colors of all of the LEDs 311*a-e* were measured. If not, the test fixture 800 returns to step 704 to turn on the next LED emitter color of the at least one LED 311*a-e* in the button zone 415*a-e* and repeats steps 706 through 708. For example, the test fixture 800 may turn on the green LEDs emitters of LEDs 311*a* in button zone 415*a* and measure and determine their intensity in MCD units and color in x,y coordinates. Then the test fixture 800 may turn on the blue LED emitters of LEDs 311*a* in button zone 415*a* and measure and determine their intensity in MCD units and color in x,y coordinates. After measuring all LED emitter colors of LED 311*a* in button zone 415*a*, the test fixture 800 repeats steps 704 through 708 to measure the color and intensity of the LED emitter colors of at least one LED 311*a-e* in another button zone 415*b-e* of the control device 100.

In step 712, after all of the LED emitter colors of all of the LED 311*a-e* of all button zones 415*a-e* have been measured, each set of the red, green, and blue calibration intensity values (in MCD units) and calibration red, green, and blue color gamut values (in x,y units) are saved in association with its respective button zone 415*a-e* in the memory of the control device 100 that is being tested—for example as follows:

TABLE 1

| Button Zone | Calibration Intensity Data | Calibration Color Data |
|---|---|---|
| 415a | $I_{R1}$, $I_{G1}$, $I_{B1}$ | ($x_{R1}$, $y_{R1}$), ($x_{G1}$, $y_{G1}$), ($x_{B1}$, $y_{B1}$) |
| 415b | $I_{R2}$, $I_{G2}$, $I_{B3}$ | ($x_{R2}$, $y_{R2}$), ($x_{G2}$, $y_{G2}$), ($x_{B2}$, $y_{B2}$) |
| . . . | . . . | . . . |
| 415n | $I_{Rn}$, $I_{Gn}$, $I_{Bn}$ | ($x_{Rn}$, $y_{Rn}$), ($x_{Gn}$, $y_{Gn}$), ($x_{Bn}$, $y_{Bn}$) |

According to one embodiment, each individual LED 311*a-e* in each button zone 415*a* can be individually calibrated according to the methods of the present embodiments for improved accuracy. As such, the test fixture 800 will turn on and measure (according to steps 704 through 708) each LED emitter color of each individual LED 311*a-e* one at a time to calibrate each LED 311*a-e* individually. For control device 100, having ten LEDs, this will result in ten calibration points each having three sets of measured color and intensity values for each of the red, green, and blue LED emitters. Accordingly, each LED 311*a-e* will be associated with a set of red, green, and blue calibration color gamut values that define the color gamut for that individual LED 311*a-e*.

According to another embodiment, all the LEDs 311*a-e* in a single button zone 415*a-e* may be calibrated together. As discussed above, each button zone 415*a-e* may be associated with a single light bar 315*a-e* and two separate RGB LEDs 311*a-e* adapted to direct light to opposite side edges 314 of a respective light bar 315*a-e* such that light from the pair of RGB LEDs 311*a-e* is distributed by the light bar 315*a-e* to light the button positioned at the respective button zone. Although each button zone 415*a-e* may comprise more than two LEDs. The calibration steps may be performed simultaneously for each pair of LEDs 311*a-e* of each button zone 415*a-e*. For example, in step 704, the red LED emitters of the pair of LEDs 311*a* in button zone 415*a* may be turned on together and measured via spectrometer 801, then the green LED emitters of the pair of LEDs 311*a* in button zone 415*a* may be turned on together and measured, and finally, the blue LED emitters of the pair of LEDs 311*a* in button zone 415*a* may be turned on together and measured. For control device 100 having five button zones 415*a-e*, this will result in five calibration points each having three sets of measured color and intensity values for each of the red, green and blue LED emitter pairs. As such, each button zone 415*a-e* will be associated with a set of red, green, and blue calibration color gamut values that defines the color gamut for that button zone 415*a-e*, for example set ($x_{R1}$, $y_{R1}$), ($x_{G1}$, $y_{G1}$), ($x_{B1}$, $y_{B1}$) for button zone 415*a*.

Referring to FIG. 13, there is shown a chromaticity diagram of an exemplary calibration color gamut 1300 of button zone 415*a*, comprising the red coordinate 1301, the green coordinate 1302, and the blue coordinate 1303 defined by the calibration color gamut values ($x_{R1}$, $y_{R1}$), ($x_{G1}$, $y_{G1}$), ($x_{B1}$, $y_{B1}$), respectively.

Referring back to FIG. 7, in step 714, the control device 100 determines combined calibration color gamut values that define the color gamut for the tested control device 100 using the button zone calibration color gamut values. The combined calibration color gamut values may be defined by red, green, and blue chromaticity coordinates using the following formula:

$$\text{Red } (x_{CR}, y_{CR}) = x_{Rmin}, y_{Rave}$$

$$\text{Green } (x_{CG}, y_{CG}) = x_{Gave}, y_{Gmin}$$

$$\text{Blue } (x_{CB}, y_{CB}) = x_{Bmax}, y_{Bmax} \qquad \text{Formula 3}$$

Referring to FIG. 9, there is shown an exemplary combined calibration color gamut 900 within the CIE 1931 color space 920 that represents the achievable color space for the tested control device 100. The combined calibration color gamut 900 is defined by a triangle made up by three coordinates of the RGB LEDs 311*a-e*, including the red coordinates ($x_{CR}$, $y_{CR}$) 901, green coordinates ($x_{CG}$, $y_{CG}$) 902, and blue coordinates ($x_{CB}$, $y_{CB}$) 903. The values for the red coordinates ($x_{CR}$, $y_{CR}$) 901 of the combined calibration color gamut 900 are obtained by selecting the minimum x value ($x_{Rmin}$) and computing the average y value ($y_{Rave}$) from the button zone calibration color gamut values of the red LED emitters of LEDs 311*a-e* (i.e., minimum x value selected from $x_{R1 \ldots n}$, and average y value determined from $y_{R1 \ldots n}$). The values for the green coordinates ($x_{CG}$,$y_{CG}$) 902 of the combined calibration color gamut 900 are obtained by computing the average x value ($x_{Gave}$) and selecting the minimum y value ($y_{Gmin}$) from the button zone color calibration gamut values of the green LED emitters of LEDs 311*a-e* (i.e., average x value determined from $x_{G1 \ldots n}$, and minimum y value selected from $y_{G1 \ldots n}$). The values for the blue coordinates ($x_{CB}$,$y_{CB}$) 903 of the combined calibration color gamut 900 are obtained by selecting the maximum x value ($x_{Bmax}$) and selecting the maximum y value ($y_{Bmax}$) from the stored color calibration data of the blue LED emitters of LEDs 311*a-e* (i.e., maximum x value selected from $X_{B1 \ldots n}$, and maximum y value selected from $y_{B1 \ldots n}$). Although, according to other embodiments, the combined calibration color gamut 900 may be determined from the plurality of button zone calibration color gamut values using different methods or relationships than the ones described above.

The combined calibration color gamut 900 determines substantially the full achievable range of colors for the tested control device 100. The combined calibration color gamut 900 essentially represents the substantially largest color space that encompasses all the colors that can be reproduced using any one of the LEDs 311*a-e*, or any one of the LED pairs, of the control device 100. As a result, combined calibration color gamut 900 will be generally smaller than the individual button zone calibration color gamuts (e.g., 1300). According to a further embodiment, the red coordinates 901, green coordinates 902, and blue coordinates 903 of the combined calibration color gamut 900 may be further offset by a small offset factor to slightly reduce the combined calibration color gamut 900 to a smaller space such that the values of the combined calibration color gamut 900 are not identical to any of the values of the button zone calibration color gamuts.

In step 716, the control device 100 saves the combined calibration color gamut in its memory.

Referring to FIG. 10, there is shown a flowchart 1000 illustrating the steps for determining a plurality of calibrated PWM intensity levels each used to drive a respective LED emitter color of at least one LED 311*a-e* in a button zone 415*a-e* according to an illustrative embodiment. In step 1002, the control device 100 receives selected target color, which may be represented using color values in a first color space that is defined by a first color gamut. The selected target color may be selected by a user or an installer, for example via a user interface of an automation setup or control application running on a computer, a browser, a mobile computing device, or the like. Referring to FIG. 11, there is shown an exemplary user interface 1100. According to one embodiment, the user interface 1100 may display a representation of the control device 1101 comprising a plurality of selectable buttons 1102*a-e* each associated with one or more button zones 415*a-e* and their associated LEDs 311*a-e* on the actual control device 100. The user may select the button 1102*a-e* for which the user desires to set or change the backlight color. For example, the user may select button 1102*d* to change the backlight color of LEDs 311*d* in button zone 415*d*. The user interface 1100 may present one or more color selection objects that may be used by the user to select a desired color to backlight the selected button 1102*d*. For example, the user interface 1100 may display a hue selection slider 1105*a* and a saturation selection slider 1105*b* for target color selection. According to another embodiment, the color selection object may comprise other forms for color selection. The user interface 1100 may comprise a rendering of a color space (such as XYZ color space 920) or of a color gamut (such as sRGB color gamut 910) that the user may touch to select a color. In another embodiment, the user interface may comprise a plurality of color fields or buttons, such as selectable color fields 1104, each preprogrammed with a predefined color from which the user can select the desired color for button backlighting. The user interface 1100 may further comprise a brightness selection object, such as a brightness selection slider 1106, allowing the user to select and dim the brightness for all the buttons 102 of the control device 102. Although according to another embodiment, the button brightness may be preset and remain constant. After a desired target color and/or brightness is selected, the values of the selected target color and the selected target intensity may be transmitted from the user interface 1100 to the control device 100.

The received target color values in the first color space may comprise sRGB target color values of the sRGB color space, with each target color value $sR_{TS}$, $sG_{TS}$, and $sB_{TS}$ in the range 0 to 1. Referring to FIG. 9, there is shown a chromaticity diagram of the sRGB color space defined by sRGB color gamut 910 (i.e., the first color gamut). sRGB color space is a "standard" RGB color space used on monitors, printers and the Internet. If the received sRGB target color values are represented in a 'bit' sRGB form, each of the received target color values $sR_{TS}$, $sG_{TS}$, and $sB_{TS}$ may be divided by the range value for the received bit form—for example, for 8-bit form each target color value may be divided by 255, and for 16-bit form each target color values may be divided by 65535. If the received target color values are in another color representation, such as the HSV (hue, saturation, value), HSL (hue, saturation, lightness), or the like, the control device 100 will first convert the received target color values to the first color space—e.g., to the sRGB color space.

In step 1004, the control device 100 stores a conversion function comprising a transformation matrix that converts color values from the first color space to a second color space as a function of color gamut variables and a reference white point variables. For example, the first color space may be an sRGB color space defined by chromaticity coordinates of the sRGB color gamut 910 (FIG. 9), and the second color space may be the XYZ color space defined by the XYZ color gamut 920 (FIG. 9). The conversion function may comprise a standard conversion function of converting color values from the sRGB color space to the XYZ color space, comprising a gamma expansion formula and the transformation matrix.

The gamma expansion formula may be used to convert the received sRGB target color values to linear RGB color values. The linear RGB color space and XYZ color space are linear vector spaces and thereby can be transformed using a transformation matrix. sRGB color space, however, is not a vector space with respect to luminance. It is gamma corrected by scaling luminance in a non-linear manner. Therefore the sRGB values need to be gamma-expanded using the following formula:

$$C_{linear} = \begin{cases} \dfrac{C_{srgb}}{12.92} & C_{srgb} \le 0.04045 \\ \left(\dfrac{C_{srgb} + 0.055}{1.055}\right)^{24} & C_{srgb} > 0.04045 \end{cases} \qquad \text{Formula 4}$$

Where, $C_{srgb}$ is $sR_{TS}$, $sG_{TS}$, or $sB_{TS}$ target color values in the sRGB color space and $C_{linear}$ is the resulting linear $R_{TS}$, $G_{TS}$, or $B_{TS}$ target color values in the linear RGB color space.

The transformation matrix to convert from linear RGB target color values to XYZ target color values may comprise the following formula:

$$[M] = \begin{bmatrix} S_R X_R & S_G X_G & S_B X_B \\ S_R Y_R & S_G Y_G & S_B Y_B \\ S_R Z_R & S_G Z_G & S_B Z_B \end{bmatrix} \qquad \text{Formula 5}$$

$$\begin{bmatrix} S_R \\ S_G \\ S_B \end{bmatrix} = \begin{bmatrix} X_R & X_G & X_B \\ Y_R & Y_G & Y_B \\ Z_R & Z_G & Z_B \end{bmatrix}^{-1} \begin{bmatrix} X_W \\ Y_W \\ Z_W \end{bmatrix}$$

$$X_R = \frac{x_R}{y_R} \quad X_G = \frac{x_G}{y_G} \quad X_B = \frac{x_B}{y_B}$$

$$Y_R = 1 \quad Y_G = 1 \quad Y_B = 1$$

$$Z_R = \frac{(1 - x_R - y_R)}{y_R}$$

$$Z_G = \frac{(1 - x_G - y_G)}{y_G}$$

$$Z_B = \frac{(1 - x_B - y_B)}{y_B}$$

M represents the transformation matrix. The XYZ tristimulus variables ($X_W$, $Y_W$, $Z_W$) represent the reference white point variables. The red ($x_R$, $y_R$), green ($x_G$, $y_G$), and blue ($x_B$, $y_B$) chromaticity coordinate variables represent the color gamut variables—which in a standard transformation matrix are set to the chromaticity coordinate values of the sRGB color gamut 910 (FIG. 9) (i.e., the first color gamut).

In step 1006, the control device sets the reference white point variables to values of a selected reference white point. The reference white point values represent a reference white point that the LEDs 311*a-e* should target. The reference white point may be represented using XYZ tristimulus values ($X_W$, $Y_W$, $Z_W$). According to one embodiment, the reference white point can be predetermined and stored by the control device 100. The reference white point can be set to the CIE standard illuminant D65 or the "daylight illuminant" defined by the International Commission on Illumination (CIE) for a typical daylight at 6500 Kelvin (K), which is shown as target white point ($T_W$) 915 in FIG. 9. It can be defined using the following XYZ tristimulus values: X=94.8110, Y=100.00, and Z=107.304. Using the D65 reference white point, the LEDs 311 will target white as it would be perceived at daylight. However, this reference white point can be set to a different color temperature of white, anywhere between 2000K and above 5500K, if it desired for the LEDs 311 to target cooler or warmer white. According to another embodiment, a desired reference white point may be chosen by the user or installer using user interface 1100, for example via a white color temperature object in a form of a slider (not shown).

In step 1008, the control device 100 sets the color gamut variables to the combined calibration color gamut values and in step 1010 the control device 100 computes a calibrated transformation matrix using the selected reference white point and the combined calibration color gamut. Accordingly, instead of using the red ($x_R$, $y_R$), green ($x_G$, $y_G$), and blue ($x_B$, $y_B$) chromaticity coordinates of the sRGB color gamut 910 (FIG. 9) (i.e., the first color gamut) in the transformation matrix (M), the control device 100 uses the chromaticity coordinates of the combined calibration color gamut 900 (FIG. 9) as determined pursuant to FIG. 7 to determine a calibrated transformation matrix ($M_C$). The calibrated transformation matrix will then comprise the following formula:

$$[M_C] = \begin{bmatrix} S_R X_R & S_G X_G & S_B X_B \\ S_R Y_R & S_G Y_G & S_B Y_B \\ S_R Z_R & S_G Z_G & S_B Z_B \end{bmatrix} \quad \text{Formula 6}$$

$$\begin{bmatrix} S_R \\ S_G \\ S_B \end{bmatrix} = \begin{bmatrix} X_R & X_G & X_B \\ Y_R & Y_G & Y_B \\ Z_R & Z_G & Z_B \end{bmatrix}^{-1} \begin{bmatrix} X_W \\ Y_W \\ Z_W \end{bmatrix}$$

$$X_R = \frac{x_{CR}}{y_{CR}} \quad X_G = \frac{x_{CG}}{y_{CG}} \quad X_B = \frac{x_{CB}}{y_{CB}}$$

$$Y_R = 1 \quad Y_G = 1 \quad Y_B = 1$$

$$Z_R = \frac{(1 - x_{CR} - y_{CR})}{y_{CR}}$$

$$Z_G = \frac{(1 - x_{CG} - y_{CG})}{y_{CG}}$$

$$Z_B = \frac{(1 - x_{CB} - y_{CB})}{y_{CB}}$$

$M_c$ represents the calibrated transformation matrix. The red ($x_{CR}$, $y_{CR}$), green ($x_{CG}$, $y_{CG}$), and blue ($x_{CB}$, $y_{CB}$) values represent the combined calibration color gamut coordinates. The XYZ tristimulus values ($X_W$, $Y_W$, $Z_W$) represent the selected reference white point (e.g., standard illuminant D65).

In step 1012, using the conversion function comprising the calibrated transformation matrix $M_C$, the control device 100 converts the selected target color ($T_S$) 911 in the first color space defined by a first color gamut (e.g., in the sRGB color space defined by sRGB color gamut 910) to the calibrated target color ($T_C$) 912 in the second color space (e.g., in the XYZ color space 920), for example by using the following conversion function:

$$\begin{bmatrix} X_{TC} \\ Y_{TC} \\ Z_{TC} \end{bmatrix} = [M_C] \begin{bmatrix} R_{TS} \\ G_{TS} \\ B_{TS} \end{bmatrix} \quad \text{Formula 7}$$

$M_C$ represents the calibrated transformation matrix determined in step 1010, ($R_{TS}$, $G_{TS}$, $B_{TS}$) represent the linear RGB target color values determined from the selected sRGB target color values received in step 1002 and converted to linear values via Formula 4, and ($X_{TC}$, $Y_{TC}$, $Z_{TC}$) represent the resulting calibrated XYZ target color values. Referring to FIG. 9, using the calibrated transformation matrix ($M_C$) comprising chromaticity coordinates of the combined calibration color gamut 900 instead of the sRGB color gamut 910 (i.e., the first color gamut) in the conversion function, effectively shifts the values of the selected target color ($T_S$) 911 from the sRGB color gamut 910 to the combined calibration color gamut 900 to get values for the calibrated target color ($T_C$) allowing the LEDs 311 of the control device 100 to target the colors achievable by the particular LEDs 311 instead of being restricted to the limited color gamut 910 of the sRGB space or another color space used when selecting the desired target color value using the user interface 111 (i.e., the first color space defined by the first color gamut). According to another embodiment, instead of using the combined calibration color gamut to determine a single calibrated transformation matrix, the control device 100 may determine a plurality of calibrated transformation matrixes, each for a respective button zone 415*a-e* and each using the associated button zone calibration color gamut for the color gamut variables. This will result in a plurality of calibrated target colors for each button zone 415*a-e* in step 1012.

Next in step 1014, for each button zone 415*a-e*, the control device 100 determines color ratios for each of the LED emitter colors using the values of the calibrated target color ($T_C$) and the associated button zone calibration color gamut. Each of the red, green, and blue color ratios defines the proportional amount each of the red, green, and blue LED emitters of the LEDs 311*a-e* in the respective button zone 415*a-e* need to be turned on to get to the calibrated target color ($T_C$) 912. The control device 100 determines individual color ratios for each button zone 415*a-e* using the value of associated button zone calibration color gamut. The color ratios for each button zone 415*a-e* may be determined using the center of gravity approach. Referring to FIG. 13, there is shown a chromaticity diagram of an exemplary calibration color gamut 1300 of a single button zone, for example button zone 415*a*, comprising the red coordinate 1301, the green coordinate 1302, and the blue coordinate 1303 defined by the calibration color gamut values ($x_{R1}$, $y_{R1}$), ($x_{G1}$, $y_{G1}$), ($x_{B1}$, $y_{B1}$), respectively. First, the control device 100 determines the slope and the y-intercept or offset of line 1304 formed between the red color coordinate 1301 and the blue color coordinate 1303 of the respective button zone calibration color gamut 1300 using the following formula:

$$S_{RB} = \frac{(y_{Rn} - y_{Bn})}{(x_{Rn} - x_{Bn})}$$
$$O_{RB} = y_{Bn} - S_{RB} \times x_{Bn}$$
Formula 8

$S_{RB}$ represents the slope of line 1304, $O_{RB}$ represents the offset of line 1304, ($x_{Rn}$, $y_{Rn}$) represent the values of the red color coordinate 1301 of a button zone calibration color gamut 1300, and ($x_{Bn}$, $y_{Bn}$) represent the values of the blue color coordinate 1303 of a button zone calibration color gamut 1300. Next, the control device 100 determines the slope and offset of line 1306 formed between the green color coordinate 1302 of the respective button zone calibration color gamut 1300 and the calibrated target color coordinate ($T_C$) 912 using the following formula:

$$S_{GT} = \frac{(y_{Gn} - y_T)}{(x_{Gn} - x_T)}$$
$$O_{GT} = y_{Gn} - S_{GT} \times x_T$$
Formula 9

$S_{GT}$ represents the slope of line 1306, $O_{GT}$ represents the offset of line 1306, ($x_{Gn}$, $y_{Gn}$) represent the values of the green color coordinate 1302 of the button zone calibration color gamut 1300, and ($x_T$, $y_T$) represent the values of the calibrated target color ($T_C$) 912. The control device 100 then determines the x,y intercept point 1308 (referred to as the purple point P) of these two lines 1304 and 1306 by calculating the two slope formulas as two equations with two unknowns, using the following formula:

$$x_P = \frac{(O_{RB} - O_{GT})}{(S_{GT} - S_{RB})}$$
$$y_P = (S_{RB} \times x_p) + O_{RB}$$
Formula 10

Where ($x_P$, $y_P$) are the values of the chromaticity coordinates of the purple point (P) 1308, $O_{RB}$ is the offset of line 1304, $O_{GT}$ is the offset of line 1306, $S_{GT}$ is the slope of line 1306, and $S_{RB}$ is the slope of line 1304. Finally, the control device 100 determines the color ratios for each of the LED emitter colors in the respective button zone 415*a-e* using the following formula:

$$F_R = \frac{F_{RB}}{(F_{RB} + 1)}$$
$$F_{RB} = -\left(\frac{y_{Rn}}{y_{Bn}}\right) \times \frac{(y_{Bn} - y_P)}{(y_{Rn} - y_P)}$$
$$F_B = \frac{1}{(F_{RB} + 1)}$$
$$F_{GP} = -\left(\frac{y_{Gn}}{y_{Pn}}\right) \times \frac{(y_P - y_T)}{(y_{Gn} - y_T)}$$
$$F_G = F_{GP}$$
Formula 11

Where, $F_R$ is the red color ratio, $F_G$ is the green color ratio, $F_B$ is the blue color ratio, ($y_{Rn}$, $y_{Gn}$, $y_{Bn}$) are the values of the y coordinates 1301, 1302, 1303 of the calibration color gamut 1300, $y_P$ is the value of the y coordinate of the purple point P 1308, and $y_T$ is the value of they coordinate of the calibrated target color ($T_C$) 912. According to another embodiment, instead of computing the purple point P 1308, the ratios may be determined by computing the intercepting point between the other coordinate pairs, for example, the intercept between the line between the green and blue coordinates 1302 and 1303 and the line between the red coordinate 1301 and the calibrated target color 912, or the intercept between the line between the green and red coordinates 1302 and 1301 and the line between the blue coordinate 1303 and the calibrated target color 912.

In step 1016, for each LED emitter color in each button zone 415*a-e*, the control device 100 normalizes the color ratio using predetermined maximum target intensity values to determine a normalized color ratio, for example by using the following formula:

$$F_{NR} = F_R \times F_{Ri}$$
$$F_{NG} = F_G \times F_{Gi}$$
$$F_{NB} = F_B \times F_{Bi}$$
$$F_{Ri} = \frac{I_{Bi}}{I_{Ri}};\ F_{Gi} = \frac{I_{Bi}}{I_{Gi}};\ F_{Bi} = \frac{I_{Bi}}{I_{Bi}}$$
Formula 12

$F_{NR}$, $F_{NG}$, and $F_{NB}$ are the normalized color ratios and $F_R$, $F_G$, and $F_B$ are the color ratios determined according to Formula 11 for the red, green, and blue LED emitter colors for each button zone 415*a-e*, respectively. $F_{Ri}$, $F_{Gi}$, and $F_{Bi}$ are the normalizing intensity ratios for red, green and blue LED emitter colors that may be determined using predetermined maximum target intensity values ($I_{Ri}$, $I_{Gi}$, $I_{Bi}$) of the LEDs 311 used in the control device 100. The maximum target intensity values ($I_{Ri}$, $I_{Gi}$, $I_{Bi}$), and thereby the normalizing intensity ratios ($F_{Ri}$, $F_{Gi}$, and $F_{Bi}$), may be constant values that do not change from button zone to button zone or control device to control device. The predetermined maximum target intensity values ($I_{Ri}$, $I_{Gi}$, $I_{Bi}$) are the maximum intensity that the LED emitters of LEDs 311 are set to target via the calibration, and as an example they may comprise 445 MCD for the red emitter, 225 MCD for the blue emitter, and 1220 for the green emitter. These values may vary on the type of RGB LEDs used and from manufacturer to manufacturer. While the normalizing intensity ratios ($F_{Ri}$, $F_{Gi}$, and $F_{Bi}$) are shown in Formula 12 to be determined with respect to the maximum target intensity of the blue LED emitter, the formula may be adjusted to determine normalizing intensity ratios with respect to the maximum target intensity of the red LED emitter or the green LED emitter. The control device 100 determines normalized color ratios ($F_{NR}$, $F_{NG}$, and $F_{NB}$) by adjusting each color ratio ($F_R$, $F_G$, and $F_B$) by the normalizing intensity ratio ($F_{Ri}$, $F_{Gi}$, and $F_{Bi}$) of the respective color. This step normalizes the intensity of the emitters of the LEDs 311 to the maximum target intensity such that their brightness appears consistent regardless of the chosen color of each button zone 415*a-e*.

In step 1018, for each LED emitter color in each button zone 415*a-e* the control device 100 determines the pulse width modulation (PWM) intensity at which to drive the respective LED emitter color based on a selected target intensity value and the normalized color ratio. For a 16-bit channel, the PWM signal output to each LED emitter color would range between 0 and 65535. The methods described herein, however, can be applied to other channel sizes without departing from the scope of the embodiments. The control device 100 may determine the PWM intensity using the following formula:

$$PWM_R = \left(\frac{I_T^\gamma}{1 + \frac{F_{NG}^\gamma + F_{NB}^\gamma}{F_{NR}^\gamma}}\right)^{\frac{1}{\gamma}}$$

$$PWM_G = \left(\frac{PWM_R}{F_{NR}}\right) \times F_{NG}$$

$$PWM_B = \left(\frac{PWM_R}{F_{NR}}\right) \times F_{NB}$$

Formula 13

Where $PWM_R$, $PWM_G$, $PWM_B$ are the PWM intensity for the red, green, and blue LED emitters and $F_{NR}$, $F_{NG}$, and $F_{NB}$ are the red, green, and blue normalized color ratios. The formulas for $PWM_G$ and $PWM_B$ are similar to the $PWM_R$ but are shown simplified in Formula 13 as once one PWM value is solved for one color, the other colors are ratios of the solved color. γ in Formula 13 indicates a gamma correction value that can be subjectively chosen based on the medium it is used for as is known in the art and is usually a value between 1.5 and 3. It adjusts how bright mixed colors are perceived in relation to how bright single colors are perceived to a user. $I_T$ is a selected target intensity value that defines the desired brightness level at which to drive the LEDs 311*a-e*. $I_T$ may be any value between 0 and 65535 for a 16-bit channel. According to one embodiment, the brightness is predetermined during manufacturing and cannot be adjusted. According to another embodiment, the desired target brightness for all of the buttons can be chosen by the installer or the user, for example via brightness selection slider 1106. According to one embodiment, $I_T$ in the Formula 13 can comprise a maximum predefined intensity level preset during manufacturing. The computed PWM intensity that is driven to LED emitters of the control device 100 may be scaled down as discussed below to output a dimmed output color the control device 100 based on a desired brightness intensity selected by the user or via an input from a light sensor, such as light sensor 317.

In step 1020, for each LED emitter color in each button zone 415*a-e*, the control device 100 calibrates the PWM intensity at which to drive the respective LED emitter color using the stored calibration intensity value to determine a calibrated PWM intensity, for example, using the following formula:

$$PWM_{CR} = PWM_R \times F_{Rc}$$

$$PWM_{CG} = PWM_G \times F_{Gc}$$

$$PWM_{CB} = PWM_B \times F_{Bc}$$

$$F_{Rc} = \frac{I_{Ri}}{I_{Rn}};\ F_{Gc} = \frac{I_{Gi}}{I_{Gn}};\ F_{Bc} = \frac{I_{Bi}}{I_{Bn}}$$

Formula 14

$PWM_{CR}$, $PWM_{CG}$, $PWM_{CB}$ are the calibrated PWM intensity values and $PWM_R$, $PWM_G$, $PWM_B$ are the PWM intensity values determined according to Formula 13, for the red, green, and blue LED emitters in each button zone 415*a-e*. $F_{Rc}$, $F_{Gc}$, and $F_{Bc}$ are the calibration intensity ratios for each of the red, green, and blue LED colors that are determined using the maximum target intensity values ($I_{Ri}$, $I_{Gi}$, $I_{Bi}$) as well as the stored calibration intensity values ($I_{R1 \ldots n}$, $I_{G1 \ldots n}$, and $I_{B1 \ldots n}$) as discussed above with reference to FIG. 7 and Table 1. This step further calibrates the intensity of the LED emitter colors of the LEDs 311 to measured intensity of the emitters such that their brightness appears consistent regardless of the chosen color of each button zone 415*a-e*.

In step 1022, the control device 100 drives each LED emitter color of the LEDs 311*a-e* in each button zone 415*a-e* with its respective calibrated PWM intensity value ($PWM_{CR}$, $PWM_{CG}$, $PWM_{CB}$). As discussed above, this calibrated PWM intensity value may be further scaled down, either linearly or non-linearly, for example via a log function, to produce a dimmed output color based on a predefined scaling down factor or based on a target brightness value selected by the user, for example via brightness selection slider 1106 on user interface 1100 (FIG. 11).

In FIGS. 7 and 10 discussed above, the drive current used to drive the LED emitter colors of the LEDs 311*a-e* in all button zones 415*a-e* can be a predetermined value (e.g., 20 mA), or it can be set to a different drive current value for each LED emitter color. According to another embodiment, instead of using one or more predetermined current values, the present embodiments provide for a current calibration sequence that may be performed to obtain a calibrated current value for each LED emitter color of at least one LED 311*a-e* in each button zone 415*a-e*. This will allow for the control device 100 to compensate for the mechanical variances of the unit and variances of the RGB LEDs, which can be extremely wide. The above variances can cause high percentage of units to be rejected for falling out of range for improper resolution at low brightness to produce color accurately.

Referring to FIG. 14, there is shown a flowchart 1400 illustrating the steps for determining calibrated drive current values for each LED emitter color of at least one LED 311*a-e* in each button zone 415*a-e*, after the control device 100 is placed in and connected to the test fixture 800 in step 702 and before step 704 of FIG. 7. In step 1402, the test fixture 800 sets a target test intensity, for example in MCD units, for each LED emitter color. Each target test intensity may comprise an average brightness value of the bin of LEDs used. For example, the target test intensity values may comprise 1,000 MCD for red, 2,500 MCD for green, and 615 MCD for blue LED emitter colors. In step 1404, the test fixture 800 initializes the LED driver of control device 100 to a maximum current value, which may represent the maximum current rating for the LEDs 311*a-e* used in control device 100. For example, the maximum current value may comprise 20 mA. In step 1406, the test fixture 800 turns on one LED emitter color of at least one LED 311*a-e* in one button zone 415*a-e* at the set maximum current value. As discussed above, the test fixture 800 can calibrate the drive current of each LED 311*a-e* individually, or it may calibrate the drive current of all of the LEDs 311*a-e* in each button zone 415*a-e* together. In step 1408, the spectrometer 801 measures the intensity of the turned on LED emitter color of the subject LEDs 311*a-e* in one of the button zones 415*a-e*. As discussed above, the measured test intensity may be measured using Lux units and then converted to MCD units according to Formula 2 as discussed above.

In step 1410, the test fixture 800 determines an intensity test ratio using the target test intensity and the measured test intensity, for example using the following formula:

$$F_{Rt} = \frac{I_{Rt}}{I_{Rm}};\ F_{Gt} = \frac{I_{Gt}}{I_{Gm}};\ F_{Bt} = \frac{I_{Bt}}{I_{Bm}}$$

Formula 15

Where, ($F_{Rt}$, $F_{Gt}$, $F_{Bt}$) are intensity test ratios for the red, green, and blue LED emitter colors, ($I_{Rt}$, $I_{Gt}$, $I_{Bt}$) are target test intensities for the red, green, and blue LED emitter colors, and ($I_{Rm}$, $I_{Gm}$, $I_{Bm}$) are measured test intensities for the red, green, and blue LED emitter colors.

In step 1412, the test fixture 800 determines whether the determined intensity test ratio is greater or equals to 1. If yes, then in step 1414, the test fixture 800 sets the drive current of the tested LED emitter color of the at least one LED 311*a-e* of the respective button zone 415*a-e* to the maximum current value ($J_{max}$). If the intensity test ratio is smaller than 1, then in step 1416 the test fixture 800 multiplies the determined intensity test ratio ($F_{Rt}$, $F_{Gt}$, or $F_{Bt}$) by the maximum current value ($J_{max}$) and sets the tested LED emitter color of the at least one LED 311*a-e* of the respective button zone 415*a-e* to that multiplied result. This causes the drive current to be reduced from the maximum current value ($J_{max}$) by the intensity test ratio ($F_{Rt}$, $F_{Gt}$, or $F_{Bt}$) such that the LEDs 311*a-e* of the control device 100 do not overshoot their limits and fail color and intensity calibration steps.

In step 1418, the test fixture 800 determines whether all of the emitter colors of all of the LEDs 311*a-e* were measured. If not, the test fixture 800 returns to step 1406 to turn on the next LED emitter color of the at least one LED 311*a-e* on the button zone 415*a-e* and repeats steps 1408 through 1418. In step 1420, after all of the LED emitter colors of all of the LED 311*a-e* of all button zones 415*a-e* have been measured, each set of the red, green, and blue calibrated drive currents ($J_R$, $J_G$, $J_B$) are saved in association with its respective button zone 415*a-e* in the memory of the control device 100 that is being tested, for example as calibrated drive current values ($J_{R1 \ldots n}$, $J_{G1 \ldots n}$, $J_{B1 \ldots n}$). These stored calibrated drive current values for each LED emitter color of at least one LED 311*a-e* in each button zone 415*a-e* are then used to drive the corresponding LED emitter colors of the corresponding button zones 415*a-e* when obtaining the color and brightness calibration data according to steps 704 through 716 in FIG. 7 and when driving the LEDs according to a chosen target color according to FIG. 10.

According to various embodiments, at least some of the steps in FIGS. 7, 10, and 14, may be performed during manufacturing, during startup of the control device 100 (e.g., after each power cycle), or during the runtime of the control device 100, in any combinations. For example, for predefined colors from which the user can select the desired color for button backlighting (e.g., via selectable color fields 1104, FIG. 11), the control device 100 may predetermine the calibrated PWM intensity values ($PWM_{CR}$, $PWM_{CG}$, $PWM_{CB}$) for each LED emitter color of at least one LED 311*a-e* in each button zone 415*a-e* during manufacturing or at startup. For custom target colors or custom brightness, the control device 100 may determine the calibrated PWM intensity values ($PWM_{CR}$, $PWM_{CG}$, $PWM_{CB}$) during runtime, for example, after the user selects the desired color. In addition, while some steps are said to be performed by the test fixture 800 and other by the control device 100, the steps may be performed by either one as applicable and in any combination. Furthermore, while particular equations and unit types were described in the specification above, these equations and unit types may vary without departing from the scope of the present embodiments. For example, the alternative equations described in the U.S. Provisional Application No. 62/803,642, filed on Feb. 11, 2019, to which this application claims priority and the entire disclosure of which is hereby incorporated by reference, may be alternatively utilized. In addition, some of the steps described above may be altered or omitted.

INDUSTRIAL APPLICABILITY

The disclosed embodiments provide an apparatus, system, and method for the calibration of backlight LEDs of control device buttons to achieve color uniformity and to accurately create colors that are consistent from button to button and device to device. It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

Additionally, the various methods described above are not meant to limit the aspects of the embodiments, or to suggest that the aspects of the embodiments should be implemented following the described methods. The purpose of the described methods is to facilitate the understanding of one or more aspects of the embodiments and to provide the reader with one or many possible implementations of the processed discussed herein. The steps performed during the described methods are not intended to completely describe the entire process but only to illustrate some of the aspects discussed above. It should be understood by one of ordinary skill in the art that the steps may be performed in a different order and that some steps may be eliminated or substituted.

All United States patents and applications, foreign patents, and publications discussed above are hereby incorporated herein by reference in their entireties.

Alternate Embodiments

Alternate embodiments may be devised without departing from the spirit or the scope of the different aspects of the embodiments.

What is claimed is:

1. A control device comprising:

a plurality of button zones each comprising at least one LED adapted to backlight the respective button zone, wherein each LED comprises a red emitter color, a green emitter color, and a blue emitter color;

a memory comprising:

a plurality of button zone calibration color gamuts each associated with one of the button zones and defines measured range of colors that can be achieved by the at least one LED in the associated button zone;

a combined calibration color gamut determined using the plurality of calibration color gamuts; and a conversion function comprising a transformation matrix that converts color from a first color space to a second color space as a function of color gamut variables and white point variables;

a controller electrically connected to each LED, wherein the controller:

determines a calibrated transformation matrix by setting the reference white point variables in the transformation matrix to values of a selected reference white point, and setting the color gamut variables to values of the combined calibration color gamut;

converts a selected target color defined in the first color space to a calibrated target color defined in the second color space using the conversion function comprising the calibrated transformation matrix;

for each LED emitter color of the at least one LED in each button zone, determines PWM intensity at which to drive the respective LED emitter color based on the calibrated target color; and drives each LED emitter color in each button zone with the respective PWM intensity.

2. The control device of claim 1, wherein each button zone calibration color gamut comprises color values each defines a measured color of one of the LED emitter colors of the at least one LED in the respective button zone.

3. The control device of claim 1, wherein the combined calibration color gamut defines a range of colors that can be achieve by the control device.

4. The control device of claim 1, wherein each button zone calibration gamut comprises a red coordinate defined by x and y values, a green coordinate defined by x and y values, and a blue coordinate defined by x and y values, wherein the combined calibration color gamut comprises:

a red coordinate defined by a minimum x value and an average y value determined from the red coordinates of the button zone calibration gamuts, a green coordinate defined by an average x value and a minimum y value determined from the green coordinates of the button zone calibration gamuts, and a blue coordinate defined by a maximum x value and a maximum y value determined from the blue coordinates of the button zone calibration gamuts.

5. The control device of claim 1, wherein the second color space is an XYZ color space.

6. The control device of claim 5, wherein the first color space is selected from a group consisting of RGB, sRGB, HSV, and HSL.

7. The control device of claim 5, wherein the first color space comprises an sRGB color space, and wherein the conversion function comprises a gamma expansion formula adapted to convert the selected target color from sRGB values to linear RGB values.

8. The control device of claim 7, wherein the calibrated transformation matrix comprises the following formula:

$$[M_C] = \begin{bmatrix} S_R X_R & S_G X_G & S_B X_B \\ S_R Y_R & S_G Y_G & S_B Y_B \\ S_R Z_R & S_G Z_G & S_B Z_B \end{bmatrix}$$

-continued $$\begin{bmatrix} S_R \\ S_G \\ S_B \end{bmatrix} = \begin{bmatrix} X_R & X_G & X_B \\ Y_R & Y_G & Y_B \\ Z_R & Z_G & Z_B \end{bmatrix}^{-1} \begin{bmatrix} X_W \\ Y_W \\ Z_W \end{bmatrix}$$

$$X_R = \frac{x_{CR}}{y_{CR}}$$

$$X_G = \frac{x_{CG}}{y_{CG}}$$

$$X_B = \frac{x_{CB}}{y_{CB}}$$

$$Y_R = 1$$

$$Y_G = 1$$

$$Y_B = 1$$

$$Z_R = \frac{(1 - x_{CR} - y_{CR})}{y_{CR}}$$

$$Z_G = \frac{(1 - x_{CG} - y_{CG})}{y_{CG}}$$

$$Z_B = \frac{(1 - x_{CB} - y_{CB})}{y_{CB}}$$

where, $M_c$ is the calibrated transformation matrix, $x_{CR}$, $y_{CR}$ are values of a red coordinate of the combined calibration color gamut, $x_{CG}$, $y_{CG}$ are values of a green coordinate of the combined calibration color gamut, $x_{CB}$, $y_{CB}$ are values of a blue coordinate of the combined calibration color gamut, and $X_W$, $Y_W$, $Z_W$ are values of the selected reference white point.

9. The control device of claim 1, where the selected reference white point is a predetermined white point stored by the control device.

10. The control device of claim 1, wherein the selected reference white point is selected by a user and received by the control device.

11. The control device of claim 1, wherein the selected target color is selected by a user and received by the control device.

12. The control device of claim 1, wherein in determining the PWM intensity for each LED emitter color in each button zone, the controller further:

determines a set of color ratios for the LED emitter colors that define relationships between the calibrated target color and the respective button zone calibration color gamut.

13. The control device of claim 12, wherein in determining the PWM intensity for each LED emitter color in each button zone, the controller further:

normalizes the respective color ratio using a normalizing intensity ratio that defines a relationship between predetermined maximum target intensities of LED emitter colors.

14. The control device of claim 12, wherein the memory further comprises a plurality of sets of calibration intensities, each set associated with one of the button zones and defines measured intensities of the LED emitter colors of the at least one LED in the associated button zone, wherein the controller further:

for each LED emitter color in each button zone, calibrates the respective PWM intensity using respective calibration intensity ratios each defining a relationship between a predetermined maximum target intensity for the respective LED emitter color and the respective calibration intensity.

15. The control device of claim 12, wherein the controller further determines PWM intensity at which to drive the respective LED emitter color based on a selected target intensity.

16. The control device of claim 12, wherein the set of color ratios are determined using the following formula:

$$F_R = \frac{F_{RB}}{(F_{RB}+1)}$$

$$F_{RB} = -\left(\frac{y_{Rn}}{y_{Bn}}\right) \times \frac{(y_{Bn}-y_P)}{(y_{Rn}-y_P)}$$

$$F_B = \frac{1}{(F_{RB}+1)}$$

$$F_{GP} = -\left(\frac{y_{Gn}}{y_{Pn}}\right) \times \frac{(y_P-y_T)}{(y_{Gn}-y_T)}$$

$$F_G = F_{GP}$$

where, $F_R$ is the color ratio for the red LED emitter color, $F_G$ is the color ratio for the green LED emitter color, $F_B$ is the color ratio for the blue LED emitter color, $y_{Rn}$, $y_{Gn}$, $y_{Bn}$ are values of red, green, and blue y coordinates of one of the respective button zone calibration color gamuts, $y_P$ is a y coordinate of a point where a first and a second line intercept, the first line being between a first and a second coordinate of the respective button zone calibration color gamut, and the second line being between a third coordinate of the respective button zone calibration gamut and a coordinate of the calibrated target color, and $y_T$ is a y coordinate of the calibrated target color.

17. The control device of claim 16, wherein the controller determines the PWM intensity for each LED emitter color in each button zone using the following formula:

$$PWM_R = \left(\frac{I_T^\gamma}{1+\frac{F_G^\gamma+F_B^\gamma}{F_R^\gamma}}\right)^{\frac{1}{\gamma}}$$

$$PWM_G = \left(\frac{PWM_R}{F_R}\right) \times F_G$$

$$PWM_B = \left(\frac{PWM_R}{F_R}\right) \times F_B$$

where, $PWM_R$ is the PWM intensity for the red LED emitter color, $PWM_G$ is the PWM intensity for the green LED emitter color, $PWM_B$ is the PWM intensity for the blue LED emitter color, $\gamma$ is a predetermined gamma correction value, and $I_T$ is a selected target intensity.

18. The control device of claim 16, wherein the memory further comprises a plurality of sets of calibration intensities, each set associated with one of the button zones and defines measured intensities of the LED emitter colors of the at least one LED in the associated button zone, wherein the controller further:

for each LED emitter color in each button zone, calibrates the PWM intensity using calibration intensity ratios each defining a relationship between a predetermined maximum target intensity of the respective LED emitter color and the respective calibration intensity using the following formula:

$$PWM_{CR} = PWM_R \times F_{Rc}$$

$$PWM_{CG} = PWM_G \times F_{Gc}$$

$$PWM_{CB} = PWM_B \times F_{Bc}$$

$$F_{Rc} = \frac{I_{Ri}}{I_{Rn}};\ F_{Gc} = \frac{I_{Gi}}{I_{Gn}};\ F_{Bc} = \frac{I_{Bi}}{I_{Bn}}$$

where, $PWM_{CR}$ is the calibrated PWM intensity for the red LED emitter color, $PWM_{CG}$ is the calibrated PWM intensity for the green LED emitter color, $PWM_{CB}$ is the calibrated PWM intensity for the blue LED emitter color, $PWM_R$ is the PWM intensity for the red LED emitter color, $PWM_G$ is the PWM intensity for the green LED emitter color, $PWM_B$ is the PWM intensity for the blue LED emitter color, $I_{Ri}$ is the predetermined maximum target intensity for the red LED emitter color, $I_{Gi}$ is the predetermined maximum target intensity for the green LED emitter color, $I_{Bi}$ is the predetermined maximum target intensity for the blue LED emitter color, $I_{Rc}$ is the respective calibration intensity of the red LED emitter color, $I_{Gc}$ is the respective calibration intensity of the green LED emitter color, and $I_{Bc}$ is the respective calibration intensity of the blue LED emitter color.

19. The control device of claim 16, wherein in determining the PWM intensity for each LED emitter color in each button zone, the controller further:

normalizes the color ratio using a predetermined maximum target intensity of the respective LED emitter color using the following formula:

$$F_{NR} = F_R \times F_{Ri}$$

$$F_{NG} = F_G \times F_{Gi}$$

$$F_{NB} = F_B \times F_{Bi}$$

$$F_{Ri} = \frac{I_{Bi}}{I_{Ri}};\ F_{Gi} = \frac{I_{Bi}}{I_{Gi}};\ F_{Bi} = \frac{I_{Bi}}{I_{Bi}}$$

where, $F_{NR}$ is the normalized color ratio for the red LED emitter color, $F_{NG}$ is the normalized color ratio for the green LED emitter color, $F_{NB}$ is the normalized color ratio for the blue LED emitter color, $I_{Ri}$ is the predetermined maximum target intensity for the red LED emitter color, $I_{Gi}$ is the predetermined maximum target intensity for the green LED emitter color, and $I_{Bi}$ is the predetermined maximum target intensity for the blue LED emitter color.

20. The control device of claim 19, wherein the controller determines the PWM intensity for each LED emitter color in each button zone using the following formula:

$$PWM_R = \left(\frac{I_T^\gamma}{1 + \frac{F_{NG}^\gamma + F_{NB}^\gamma}{F_{NR}^\gamma}}\right)^{\frac{1}{\gamma}}$$

$$PWM_G = \left(\frac{PWM_R}{F_{NR}}\right) \times F_{NG}$$

$$PWM_B = \left(\frac{PWM_R}{F_{NR}}\right) \times F_{NB}$$

where, $PWM_R$ is the PWM intensity for the red LED emitter color, $PWM_G$ is the PWM intensity for the green LED emitter color, $PWM_B$ is the PWM intensity for the blue LED emitter color, $\gamma$ is a predetermined gamma correction value, and $y_T$ is a y coordinate of the calibrated target color.

21. The control device of claim 18, wherein each button zone further comprises a light bar positioned over the at least one LED, wherein each measured intensity is defined using Lux units, and wherein each measured intensity is converted to a calibration intensity in MCD units using the following formula:

$$I_{MCD} = \left(\left(\frac{I_{Lux}}{AF}/\cos\Theta\right) \times D^2\right)1000$$

where, $I_{MCD}$ is the converted calibration intensity in MCD units, $I_{Lux}$ is the measured intensity in Lux units, AF is an attenuation factor of the light bar, D is a distance from a measuring device to the light bar, and $\Theta$ is an angle between the measuring device and the light bar.

22. The control device of claim 1, wherein the memory further comprises:

a plurality of calibrated drive currents each associated with one of the LED emitter colors of the at least one LED in each button zone, wherein the plurality of calibrated drive currents are determined using respective test intensity ratios each defines a relationship between a respective predetermined target test intensity and a measured test intensity that defines a measured intensity of the respective LED emitter color of the at least one LED in the respective button zone; and wherein the controller further drives each LED emitter color in each button zone with the respective calibrated drive current.

23. The control device of claim 21, wherein each calibrated drive current comprises a maximum current value when the respective test intensity ratio is greater or equal to one, and wherein each calibrated drive current comprises the maximum current value reduced by the respective test intensity ratio when the respective test intensity ratio is smaller than one.

24. A control device comprising:

a plurality of button zones each comprising at least one LED adapted to backlight the respective button zone, wherein each LED comprises a red emitter color, a green emitter color, and a blue emitter color;

a memory comprising:

a plurality of button zone calibration color gamuts each associated with one of the button zones and defines measured range of colors that can be achieved by the at least one LED in the associated button zone; and a conversion function comprising a transformation matrix that converts color from a first color space to a second color space as a function of color gamut variables and white point variables;

a controller electrically connected to each LED, wherein the controller:

for each button zone, determines a calibrated transformation matrix by setting the reference white point variables in the transformation matrix to values of a selected reference white point, and setting the color gamut variables to values of the associated button zone calibration color gamut;

for each button zone, converts a selected target color defined in the first color space to a calibrated target color defined in the second color space using the conversion function comprising the respective calibrated transformation matrix;

for each LED emitter color of the at least one LED in each button zone, determines PWM intensity at which to drive the respective LED emitter color based on the respective calibrated target color; and drives each LED emitter color in each button zone with the respective PWM intensity.

25. A control device comprising:

a plurality of button zones each comprising at least one LED adapted to backlight the respective button zone, wherein each LED comprises a red emitter color, a green emitter color, and a blue emitter color;

a memory comprising:

a plurality of button zone calibration color gamuts each associated with one of the button zones and defines measured range of colors that can be achieved by the at least one LED in the associated button zone;

a controller electrically connected to each LED, wherein the controller:

for each button zone, determines a set of color ratios for the LED emitter colors using a target color and the respective button zone calibration color gamut, wherein the set of color ratios are determined using the following formula:

$$F_R = \frac{F_{RB}}{(F_{RB} + 1)}$$

$$F_{RB} = -\left(\frac{y_{Rn}}{y_{Bn}}\right) \times \frac{(y_{Bn} - y_P)}{(y_{Rn} - y_P)}$$

$$F_B = \frac{1}{(F_{RB} + 1)}$$

$$F_{GP} = -\left(\frac{y_{Gn}}{y_{Pn}}\right) \times \frac{(y_P - y_T)}{(y_{Gn} - y_T)}$$

$$F_G = F_{GP}$$

where $F_R$ is the color ratio for the red LED emitter color, $F_G$ is the color ratio for the green LED emitter color, $F_B$ is the color ratio for the blue LED emitter color, $y_{Rn}$, $y_{Gn}$, $y_{Bn}$ are values of red, green, and blue y coordinates of one of the respective button zone calibration color gamuts, $y_P$ is a y coordinate of a point where a first and a second line intercept, the first line being between a first and a second coordinate of the respective button zone calibration color gamut, and the second line being between a third coordinate of the respective button zone calibration gamut and a coordinate of the calibrated target color, and $y_T$ is a y coordinate of the target color, for each LED emitter color in each button zone, determine PWM intensity at which to drive the respective LED emitter color based on the respective color ratio and a selected target intensity; and drive each LED emitter color in each button zone with the respective PWM intensity.

* * * * *